US005460936A

United States Patent [19]

Kondo et al.

[11] Patent Number: 5,460,936

[45] Date of Patent: Oct. 24, 1995

[54] SILVER HALIDE PHOTOGRAPHIC EMULSION AND SILVER HALIDE PHOTOGRAPHIC LIGHT-SENSITIVE MATERIAL

[75] Inventors: Toshiya Kondo; Sadayasu Ishikawa, both of Hino, Japan

[73] Assignee: Konica Corporation, Japan

[21] Appl. No.: 310,940

[22] Filed: Sep. 22, 1994

[30] Foreign Application Priority Data

Sep. 28, 1993 [JP] Japan ..... 5-240805

[51] Int. Cl.[6] ..... G03C 1/015; G03C 1/005

[52] U.S. Cl. ..... 430/567; 430/569

[58] Field of Search ..... 430/567, 569

[56] References Cited

U.S. PATENT DOCUMENTS

| | | | |
|---|---|---|---|
| 4,444,877 | 4/1984 | Koitabashi et al. | 430/567 |
| 4,835,095 | 5/1989 | Ohashi et al. | 430/567 |
| 4,945,037 | 7/1990 | Saitou | 430/567 |
| 4,963,467 | 10/1990 | Ishikawa et al. | 430/567 |
| 5,240,824 | 8/1993 | Takada et al. | 430/567 |

FOREIGN PATENT DOCUMENTS

| | | |
|---|---|---|
| 371338 | 6/1990 | European Pat. Off. . |
| 547912 | 6/1993 | European Pat. Off. . |
| 106737 | 4/1990 | Japan . |

*Primary Examiner*—Charles L. Bowers, Jr.
*Assistant Examiner*—Mark F. Huff
*Attorney, Agent, or Firm*—Jordan B. Bierman; Bierman and Muserlian

[57] ABSTRACT

A silver halide photographic emulsion is disclosed, wherein the silver halide emulsion contains silver halide grains having an average iodide content of not less than 4 mol %, the grains comprising an internal silver halide phase having an average iodide content of 10 mol % to a solid solution limit and a surface silver halide phase having an average iodide content of not more than 4.5 mol %.

10 Claims, No Drawings

SILVER HALIDE PHOTOGRAPHIC EMULSION AND SILVER HALIDE PHOTOGRAPHIC LIGHT-SENSITIVE MATERIAL

FIELD OF THE INVENTION

This invention relates to a silver halide photographic emulsion and a silver halide photographic light-sensitive material applied therewith, and more particularly to a silver halide photographic emulsion applicable to a silver halide photographic light-sensitive material excellent in sensitivity and graininess, and to a silver halide photographic light-sensitive material applied therewith.

BACKGROUND OF THE INVENTION

With the recent widespread of such a photographic apparatus as a camera, photo-taking opportunities have also increased with the use of a silver halide photographic light-sensitive material.

According thereto, there have been increasing demands for making sensitivity and image-quality higher.

One of the dominant factors to the high sensitivity and high image-quality of a silver halide photographic light-sensitive material is a silver halide grain. The research and development of a silver halide grain have also been progressed so far in the field of the art, with the purpose of making the sensitivity and image-quality thereof to be higher.

However, there has been a limit to satisfy both of a high sensitivity and high image-quality, because the sensitivity thereof is liable to be lowered when a silver halide grain is made smaller in grain-diameter so as to improve the image-quality, as has usually been tried.

For trying to make a sensitivity and an image-quality more higher, there have studied the techniques for improving the ratio of a sensitivity/a grain-diameter per silver halide grain. Japanese Patent Publication Open to Public Inspection (hereinafter referred to as JP OPI Publication) Nos. 58-111935/1983, 58-111936/1983, 58-111937/1983, 58 -113927/1983 and 59-99433/1984 disclose each such a technique as mentioned above in which the so-called tabular-shaped silver halide grains are used.

As the tabular-shaped silver halide grain is compared with the so-called normally crystallized silver halide grains such as those of an octahedron, an decahedron or a hexahedron, the former has such an advantage that the sensitivity thereof can be made more higher, because, when the volume of the silver halide grain of the former is the same as in the latter, the surface area of the former can be larger, so that many sensitizing dyes can be absorbed on the surface of the silver halide grain.

Also, JP OPI Publication No. 63-92942/1988 describes a technique in which a core having a high silver iodide content is arranged to the inside of a tabular-shaped silver halide grain; JP OPI Publication No. 63-151618/1988 describes a technique in which a hexagonal, tabular-shaped silver halide grain is used; and JP OPI Publication No. 63-163451/1988 describes a technique in which a tabular-shaped silver halide grain having not less than 5 in a ratio of the grain thickness thereof/the longest distance between the twined crystals thereof. These patent publications also indicate each the effects on a sensitivity and a graininess.

Further, JP OPI Publication No. 63-106746/1988 describes a technique making use of a tabular-shaped silver halide grain having substantially a layer-structure parallel to two major faces opposed to each other; and JP OPI Publication No. 1 -279237/1989 describes a technique making use of a tabular-shaped silver halide grain having a layer-structure partitioned substantially by a plane parallel to two major faces opposed to each other, and having an average silver iodide content of the outermost layer that is at least not less than 1 mol % higher than the average silver iodide content of the whole silver halide grain.

Still further, JP OPI Publication No. 1-183644/1989 discloses a technique making use of a tabular-shaped silver halide grain comprising silver halide containing silver iodide having a completely uniform silver iodide distribution.

Besides the above, there is also a known technique in which a carrier can be controlled in a metal doping treatment.

The above-mentioned metal-doping treatment is a technique in which photographic characteristics can be improved by containing mainly a polyvalent metal compound in a silver halide grain.

JP OPI Publication Nos. 62-7042/1987 and 1-105940/1989 disclose each a technique for doping an Ir ion, and JP OPI Publication No. 1-121844/1989 discloses a technique for doping an Fe ion.

JP OPI Publication Nos. 3-196135/1991 and 3-189641/1991 disclose each a silver halide photographic emulsion prepared in the presence of an oxidizer for silver, and the effects to a sensitivity and fogginess each produced when making use of a silver halide photographic light-sensitive material in which the emulsion is used.

Further, for example, JP OPI Publication No. 63 -220238/1988 discloses a technique for making use of a silver halide emulsion containing a tabular-shaped silver halide grain having a specified dislocation line number; JP OPI Publication No. 3-175440/1991 discloses a technique for making use of a silver halide emulsion containing tabular-shaped silver halide grains having the dislocation points concentrated in the neighborhood of the apices of the grains; JP Examined Publication No. 3-18695/1991 discloses a technique for making use of silver halide grains having a clear core/shell structure; and JP Examined Publication No. 3 -1245/1991 describes a technique concerning a core/shell structured silver halide grain. The above-mentioned techniques have been studied respectively as a high sensitization technique.

However, these conventional techniques have a limit to satisfy both of a high sensitivity and a high image-quality at the same time, and these techniques are not satisfactory to provide a sensitivity and an image-quality each required of the recent light-sensitive materials. Therefore, a development of a superior technique has been demanded.

SUMMARY OF THE INVENTION

It is an object of the invention is to provide a silver halide photographic emulsion capable of providing a silver halide photographic light-sensitive material high in sensitivity and excellent in graininess, and to provide a silver halide photographic light-sensitive material applied with the above-mentioned emulsion.

The above-mentioned objects of the invention can be achieved by satisfying the following constitutional requirements (1) or (2).

(1) A silver halide photographic emulsion comprising silver halide grains having an average silver iodide content of not less than 4 mol %, wherein a silver halide phase having a silver iodide content within the range of not less than 10 mol % to not more than a solid solution limit is present inside the silver halide grains, and a silver halide phase in the neighborhood of the grain surface has an average silver iodide content of not more than 4.5 mol %.

(2) The method of preparing a silver halide photographic emulsion as mentioned, wherein, after desalting in a process of preparing the silver halide photographic emulsion, but before carrying out a chemical or spectral sensitization, at least a part of the outermost silver halide phase of the silver halide grains are formed so.

DETAILED DESCRIPTION OF THE INVENTION

Silver halide grains, which are to be contained in a silver halide photographic emulsion of the invention, may have a regular crystal form such as a cube, an octahedron and a tetradecahedron, or may also have an irregular crystal form such as a spherical-shape and a tabular-shape. To these grains, any ratios of {100} face to {111} face can be applied. The grains having a complex of the above-mentioned crystal forms may also be used, and a mixture of grains having various crystal forms may further be used. It is also allowed to use a twinned-crystal silver halide grain having two parallel twin planes opposite to each other. In this case, it is preferable to use tabular-shaped silver halide grains.

The term, a twinned crystal, herein means a silver halide crystal having one or more twin plane in a grain. The classification of the crystal configurations is detailed in Klein & Moiser, Photographische Korrespondenz, Vol. 99, p. 99 and, ibid., Vol. 100, p. 57, respectively.

In the invention, when making use of a tabular-shaped silver halide grain, the ratio thereof to the whole the silver halide grains by projected area is, preferably, not less than 60% and, more preferably, not less than 70%.

In the invention, when making use of a tabular-shaped silver halide grain, an average ratio of a grain-diameter to a grain-thickness (or, an aspect ratio) is to be within the range of, preferably, not less than 1.3 to less than 5.0, more preferably, not less than 1.5 to less than 4.5 and, particularly, not less than 2.0 to less than 4.0. An average aspect ratio can be obtained by calculating out the average of the ratios of grain-diameter to the grain-thickness of the whole tabular grains.

A twinned crystal plane can be observed through a transmission type electron microscope. The observation method is as follows. First, a sample is prepared by coating a silver halide photographic emulsion on a support so that the major faces of tabular-shaped silver halide grains contained in the emulsion can approximately be oriented parallel to the support. The resulting sample is so shaved by making use of a diamond-cutter to be a thin sheet having a thickness of the order of 0.1 μm. The resulting thin sheet piece is observed through a transmission type electron microscope, so that the presence of the twinned crystal can be confirmed.

In a tabular-shaped silver halide grain of the invention, the average grain-diameter thereof is to be within the range of, preferably, not smaller than 0.1 μm to not larger than 5.0 μm, more preferably, 0.2 μm to 3.0 μm and, most preferably, 0.3 μm to 2.0 μm.

In the invention, an average grain-diameter is herein defined as a grain-diameter ri obtained when a produce of a frequency ni of a grain having a grain-diameter ri and $ri^3$ ($ni \times ri^3$) can be maximized, provided, the numbers of the grains subject to measurement is regarded as not less than 1,000 grains at random.

The term, a grain-diameter ri, means a diameter obtained when converting a projected image seen from the vertical direction to the major face of the grain into a circle having the same area as that of the projected image, in the case of a tabular-shaped silver halide grain. It also means a diameter obtained when converting the projected image of a silver halide grain into a circle having the same area as that of the grain, in the case of silver halide grains having any other configurations than a tabular-shaped silver halide grain.

A grain-diameter ri can be obtained by 10,000 to 70,000 times magnifying and photographing a tabular-shaped silver halide grain through an electron microscope and then by practically measuring the diameter of the printed image or the area of the projected grain image.

As for a silver halide photographic emulsions relating to the invention, any emulsions can be used, such as a polydisperse type emulsion having a substantially wide grain-diameter distribution and a monodisperse type emulsion having a substantially narrow grain-diameter distribution. Among them, however, a monodisperse type emulsion is preferred.

When a grain-diameter distribution is defined by the following formula, $$\text{Distribution width (\%)} = \frac{\text{Standard deviation}}{\text{Average grain-diameter}} \times 100,$$

a monodisperse type emulsion is to have a grain-diameter distribution of not more than 20% and, preferably, not more than 15%.

The above-mentioned average grain-diameter and standard deviation are to be obtained from the above-defined grain-diameter ri.

Any silver halide applicable to an ordinary silver halide emulsion, such as silver iodobromide, silver iodochloride and silver chloroiodobromide, can be used in a silver halide photographic emulsion of the invention. Among them, silver iodobromide and silver chloroiodobromide are particularly preferable.

In the invention, an average silver iodide content of a silver halide grain is to be not less than 4 mol % and, preferably, within the range of not less than 6 mol % to not more than 15 mol %. An average silver iodide content of a silver halide grain can be obtained by an X-ray fluorescence analysis.

A silver halide phase having a silver iodide content within the range of not less than 10 mol % to not more than a solid solution limit is present inside a silver halide grain of the invention. In the invention, the expression, "inside a grain", means a side inner than a grain-diameter corresponding to 80% of the volume of the silver halide, preferably 70% and, more preferably 60% thereof.

In a silver halide photographic emulsion of the invention, a silver halide grain contained therein may be an internally iodide concentrated grain, that is so-called a core/shell type grain.

The above-mentioned core/shell type grain is comprised of a core and a shell covering the core. The shell is comprised of a single or plural layers. The silver iodide contents of the core and the shell are preferable to be different from each other.

A silver iodide content of the above-mentioned core is to be within the range of, preferably, not less than 10 mol % to not more than a solid-solubility limit and, more preferably, not less than 15 mol % to not more than a solid-solubility limit. A silver iodide content of the above-mentioned shell is preferably less than 10 mol % and, more preferably, not more than 5.0 mol %. A proportion occupied by the above-mentioned core is to be within the range of, preferably, 2 to 60% of the whole volume of the grain and, more preferably, 5 to 50% thereof.

In the invention, the above-mentioned solid solution limit can be indicated by a maximum mol % of a iodide capable of making it present in the form of a solid solution. To be more concrete, it can be obtained according to the procedures described in T. H. James, "The Theory of Photographic Process", 4th Ed., p. 4, Macmillan Publishing Co. In the case of silver iodobromide, it can be obtained from the following formula;

*Imax (in mol %)=34.5+0.165 (t–25), (in which t represents a temperature, °C.)*

In the invention, it is possible to confirm, according to the following procedures, that a silver halide phase having a silver iodide content of 10 mol % to a solid solution limit is present inside a silver halide grain.

Similarly to the procedures described in the summary given by Inoue et al, that appeared in The Society of Photography and Science of Japan, The Summaries of the Lectures, pp. 46–48, a silver iodide content of a subject grain and the structure thereof can be obtained in the following manner. After dispersing silver halide grains in a methacrylic resin and then solidified, the grains are sliced into an extra-thin piece by making use of a microtome. Paying attention to the sliced samples having the cross-sectional areas from the maximum to not less than 90% thereof, and when drawing a circumcircle minimized to the cross-section, the contents and positions of silver iodide are measured, by an XMA method, on a straight line drawn from the center of the circle to the circumference, and, thereby the contents of silver iodide and the structure thereof in the grains can be obtained. The above-mentioned XMA (X-ray Micro Analysis) method will be detailed as follows. Silver halide grains are dispersed in a grid for electron microscopic observation use of an electron microscope on which an energy-dispersion type X-ray analyzer is loaded. The magnification of the electron microscope is so set as to make one grain come within the range of a CRT sight by cooling with liquid nitrogen, so that the intensities of AgLα rays and ILα rays are integrated. After an intensity ratio of ILα rays/AgLα rays is calculated out in advance, a silver iodide content can be determined by making use of a calibration curve.

With a silver halide grain of the invention, an average silver iodide content of silver halide phase in the neighborhood of the surface thereof (surface phase) is not more than 4.5 mol % and, preferably, not more than 3.0 mol %.

Next, thickness influential on an outermost surface layer will be referred. Ultimately, the outermost layer is referred to as one atom on the surface. Practically, however, it is necessary to define a certain "thickness". The reason for this is that an atom on the outermost layer is fixed at an absolute temperature of zero degree only and that the surface at ordinary temperature is not fixed due to movement and shift caused by the heat of atom on the outermost surface so that one atom layer is not a meaningful definition.

In the case of silver halide fine crystals, crystal growth, and a chemical sensitization and a spectral sensitization of the crystals are conducted in a water dispersion system. Accordingly, the surface thereof is not fixed. In the water dispersion system of silver halide, reaction that halide ions and silver ions are dissolved in water as ions and that ions in water is adsorbed and taken in grids is occurring. Since the speed of both reaction are the same, neither dissolution nor growth exist apparently. However, this exchange reaction exists. Surface in the silver halide emulsion system is defined to be the thickness from the surface on a solid side wherein exchange reaction with the aqueous solution substantially occur in the region of actual manufacturing process and temperature and time at the sensitization process.

In the invention, the expression, "silver halide phase in the neighborhood of the surface of a silver halide grain", herein means a silver halide phase in a region which X-rays penetrate and reach from a silver halide grain surface, when an average silver iodide content of the silver halide grain surface is measured in an XPS method. Such a region as mentioned above, which is within the outermost layer constituting a grain corresponds to a region of approximately 50 Å deep, including the surface of the grain.

In the invention, an average silver iodide content contained in a silver halide phase in the neighborhood of the surface of the grain, i.e., surface silver phase is indicated by a value obtained by measuring a sample prepared of the silver halide grain, in the state that the sample is cooled down to not higher than –110° C., by an XPS method.

In the XPS method having been conventionally known in the field of the art, a measurement has usually been carried out at an ordinary temperature. However, the following fact was proved according to the studies of the present inventors in the process of this invention. When an average silver iodide content in the neighborhood of the surface of the silver halide grain is measured at an ordinary temperature and in an XPS method, it cannot be said that any resulting data can correctly indicate the average silver iodide content in the neighborhood of the surface of the silver halide grain, because the silver halide grain surface is seriously destroyed by an X-ray exposure.

Particularly with a silver halide grain including, for example, a core/shell type grain in which the halide compositions thereof are different between the grain surface and the inside of the grain, or with a silver halide grain in which a phase having a high or low iodide content is localized in the outermost surface layer thereof, it was clearly proved that a measured value is seriously varied from that of the real silver halide composition due to the fact that the silver halide is decomposed by an X-ray exposure and the halide (including particularly iodine) is diffused.

According to the further studies made by the inventors, it was discovered that, for avoiding such a destroy of a grain sample as mentioned above and for correctly and reproducibly obtaining an average silver iodide content in the neighborhoood of the surface of a silver halide grain, the subject sample may be cooled down to such a temperature that the sample can scarcely be destroyed and, more concretely, the sample may be cooled down to not higher than –110° C.

The XPS method used therein is as follows.

In advance of a measurement by an XPS method, an emulsion is pretreated in the following manner. First, an aqueous 0.05 wt % proteolytic enzyme (or proteinase) solution is added to the emulsion and the resulting mixture is stirred at 45° C. for 30 minutes, so that a gelatin decomposition is carried out. Next, a centrifugal-separation is carried out, so that the emulsion grains are precipitated. After removing the resulting supernatant, distilled water is added thereto, so that the emulsion grains are dispersed in the distilled water and a centrifugal-separation is then carried out. Finally, the resulting supernatant is removed off.

Then, the emulsion grains are dispersed again in distilled water. The resulting dispersion is thinly coated on a mirror-wise-polished silicon-wafer, so that a sample subject to the measurement may be prepared.

By making use of the resulting sample, an average silver iodide content in the neighborhood of the silver halide grain surface is measured by an XPS method. For preventing the sample from destroying by the aforementioned X-ray exposure, the sample is cooled down to −110° to −120° C. in an XPS measurement chamber by making use of liquid nitrogen or liquid helium. As for a probe X-rays, Mg-Kα rays are irradiated at an X-ray source voltage of 15 KV and an X-ray source current of 40 mA.

For obtaining a halide composition in the neighborhood of the surface of a silver halide grain, the electrons of Ag3d, Br3d and I3d 3/2 are detected. The ratio of the compositions calculated out by correcting the integration intensities of each peak with a sensitivity factor. From the resulting intensity ratio, the average silver iodide content in the neighborhood of the surface of the subject silver halide grain is determined.

World Patent WO 10785/1992 disclosed that a surface-localized layer of a silver halide crystal was about 10 Å in thickness, which suggested that the exchange reaction at the solid/liquid interface occurred in a region of two to three lattice planes (4 to 6 atomic layers) of the surface. According to studies by inventors of the present invention based on electron spectroscopic analysis, the outermost silver halide phase capable of causing reaction with an aqueous solution side in a water dispersion system was determined to have a thickness of three lattice planes. Furthermore, the inventors found that by controlling this surface region of three lattice plnes in thickness, an improvement in performance derived from the reactivity of the surface was achieved. In the present invention, it is preferable that the outermost silver halide phase of three lattice planes in thickness contains 1.5 to 4.5 mol % iodide.

When making use of seed grains to form silver halide grains of the invention, the seed grains may be of the regular crystal forms such as a cube, an octahedron and a tetradecahedron, or may also be of the irregular crystal forms such as the spherical-shaped and the tabular-shaped. In these grains, any ratios of {100} face to {111} face may be used. These grains may also be the complex of plural crystal forms or of the mixture of grains having various crystal forms. Further, monodisperse type spherical-shaped seed grains described in JP Application No. 2-408178/1990 may also be used.

For preparing a silver halide photographic emulsion containing silver halide grains relating to the invention, various processes well-known in the field of the art can be used. Thus, a single-jet process, a double-jet process and a triple-jet process may be used in any combination. It is also allowed to make combination use of a process for controlling a pH and pAg of a liquid phase wherein a silver halide is produced so as to meet a silver halide growth rate.

In preparing a silver halide photographic emulsion of the invention, halide ion and silver ion may be mixed up together at the same time, or one of them may also be mixed in the presence of the other. Taking a critical growth rate of silver halide crystals into consideration, halide ion and silver ion may be added consecutively one after another or at the same time, with controlling the pH and pAg in a mixer vessel. Further, the silver halide composition of a grain may be changed by a conversion method in any courses of forming silver halide.

In preparing a silver halide photographic emulsion of the invention, it is allowed to make present a well-known silver halide solvent such as ammonia, thioether and thiourea.

A silver halide photographic emulsion of the invention can be prepared in the following manner. After carrying out a desalting treatment in the process of preparing the silver halide photographic emulsion, a silver halide grain having an average silver iodide content of not more than 4.5 mol % is supplied, as a source of silver halide, before carrying out a chemical or spectral sensitization, and at least a part of the outermost silver halide phase or the outermost shell layer of silver halide grains contained in the silver halide photographic emulsion are formed.

In the case of growing the grain by making use of a seed grain, a process of preparing a silver halide photographic emulsion in the invention include a step of growing the seed grain, a desalting step, a step of dispersing the silver halide grain, a chemical sensitization step and a spectral sensitization step, but does not include a coating solution preparation step, a coating step and any step of preparing a silver halide photographic light-sensitive material thereafter.

In the invention, the expression, "after carrying out a desalting treatment", herein means a period of time after that a silver halide grain contained in a silver halide emulsion of the invention is completely grown up except the formation of at least a part of the outermost silver halide phase or the outermost shell layer in the invention, and any unnecessary soluble salts are removed. Removal of the salts as mentioned above can be done with reference to the procedures described in Research Disclosure (hereinafter abbreviated to RD), No. 17643, Paragraph II.

In the invention, the expression, "before carrying out a chemical or spectral sensitization", herein means a time before adding a chemical or spectral sensitizer in the process of preparing a silver halide photographic emulsion of the invention. When adding an additive such as a color super-sensitizer, an antifoggant and a stabilizer in combination with the above sensitizers, the time defined by this expression include a time before adding an additive such as the above-mentioned color super-sensitizer, an antifoggant and a stabilizer. The examples of the color super-sensitizer, an antifoggant and a stabilizer are given in RD 17643, RD 18716, RD 308119 and so forth.

In the invention, after carrying out a desalting treatment in a process of preparing a silver halide photographic emulsion, silver halide fine grains are supplied before carrying out a chemical or spectral sensitization so as to form at least a part of the outermost silver halide phase or at least a part of the outermost shell layer thereof. The silver halide fine grains have an average iodide content of not more than 4.5 mol % and, preferably, not more than 3.0 mol %.

The above-mentioned silver halide fine grains may be prepared in advance of preparing a silver halide emulsion of the invention, or may also be prepared concurrently with the preparation of the silver halide emulsion. In the latter case of the concurrent preparation, it is allowed to use a process of preparing the silver halide fine grains with the use of a mixer separately provided outside of a reaction vessel in which silver halide grains are formed, as described in JP OPI Publication Nos. 1-183417/1989 and 2-44335/1990, and it would be preferable to provide an adjustment vessel and to supply the fine grains to the reaction chamber, while adjusting the silver halide fine grains formed so as to meet the grain-growth conditions of the reaction chamber.

The processes of preparing the above-mentioned silver halide fine grains include, preferably, a process of forming the grains under acidic or neutral condition (with pH ≦7).

The above-mentioned silver halide fine grains may be prepared by mixing a water-soluble silver salt and a water-soluble alkali halide, while suitably controlling a super-saturation factor. The controls of the above-mentioned super-saturation factors are referred to the descriptions in JP OPI Publication No. 63-92942/1988 or, ibid., No. 63-311244/1988.

When forming the silver halide fine grains applicable to the invention, the pAg thereof is to be, preferably, not lower than 3.0, more preferably, not lower than 5.0 and, further preferably, not lower than 8.0.

When forming the silver halide fine grains, the temperature are not higher than 50° C., preferably, not higher than 40° C. and, more preferably, not higher than 35° C. And, when forming the silver halide grains in this process, an ordinary high molecular weight-type gelatin is usable as a protective colloid.

When forming the silver halide grains at a relatively lower temperature, an Ostwald ripening reaction may be inhibited from progressing after completing the formation of the silver halide fine grains, however, gelatin is liable to be solidified by making the temperature lower. It is, therefore, preferable that a low molecular weight gelatin, a synthetic molecular compound having a protective colloid function to silver halide grains, or a natural macromolecular compound other than gelatin may be used, as described in JP OPI Publication No. 2-166442/1990. The concentration of the protective colloid is, preferably, not less than 1 wt %, more preferably, not less than 2 wt % and, further preferably, not less than 3 wt %.

Silver halide fine grains supplied to an aqueous solution containing a protective colloid, in which silver halide grains are formed is used to grow silver halide grains by an Ostwald-ripening effect. The silver halide fine grains are readily soluble, because the grain-diameter thereof is small, so that silver ions and halide ions are produced so as to make a uniform growth.

In the silver halide fine grains applicable to the invention, the grain-diameter thereof is, preferably, not larger than 0.1 μm and, more preferably, not larger than 0.05 μm.

In the invention, for forming at least a part of a surface silver halide phase of silver halide grains or at least a part of the outermost shell layer thereof by making use of the silver halide fine grains, it is preferable that, after completing a desalting treatment, the silver halide grains are dispersed in an aqueous solution containing a protective colloid and the silver halide fine grains thus dispersed are then added to a silver halide emulsion.

The silver halide fine grains may be added through a funnel or at an accelerated flow rate by making use of a pump or the like. The grains may be added upon separation into two or more parts, and ripening may also be conducted if required, after adding the silver halide fine grains.

In the invention, the term, "an aqueous solution containing a protective colloid", herein means an aqueous solution in which a protective colloid is formed of a gelatin or a substance capable of forming hydrophilic colloid. Such a solution as mentioned above is, preferably, an aqueous gelatin solution.

In the invention, when forming at least a part of the surface silver halide phase or outermost shell layer of silver halide grains, an aqueous solution containing a protective colloid in which the silver halide grains are dispersed has a temperature within the range of 40° to 80° C. and, preferably, 50° to 70° C. The pH thereof is within the range of 2 to 10 and, preferably, 4 to 8. The pBr thereof is to be 0.2 to 3.5 and, preferably, 0.5 to 2.5. It is preferable not to add any silver halide solvent. It is also allowed to add an aqueous solution containing a water-soluble silver salt, a water-soluble halide or a protective colloid before, after or in the midway of adding the silver halide fine grains. However, it is preferable not to add any aqueous silver salt solution and/or any water-soluble halide, as far as the silver halide fine grains are being added or ripened.

In the invention, the expression, "a surface silver halide phase of silver halide grains", herein means a silver halide phase in a region having a depth of 50 Å in the direction from the silver halide grain surface toward the direction of the grain center.

In the invention, at least a part of the surface silver halide phase or the outermost shell layer of each silver halide grain can be formed by supplying a aforementioned silver halide fine grain. The above-mentioned fact can be confirmed by observing the grain-diameters of each silver halide grain through an electron microscope, before supplying the silver halide fine grains and after the silver halide grains are grown up by supplying the fine grains.

In the invention, the term, "the outermost shell layer", herein means a silver halide phase region occupying 20% of the volume of the silver halide grain, that is positioned in the direction of from the surface to the center of the grain, and that also includes the surface silver halide phase as mentioned above.

The silver halide emulsion of the invention comprises preferably silver hlaide grains for which inner portion is reduction-sensitized.

The time the inner portion of grains are formed refers to the time of forming a silver halide phase corresponding to the inner portions of the grains from the beginning of the silver halide phase growth by supplying a silver ion, a halide ion and/or silver halide grains through the completion of the silver halide phase.

In silver halide grains contained in the silver halide photographic emulsion of the present invention, the inner portion of the silver halide grains is referred to as, when a seed grain is used for manufacturing aforesaid silver halide grains, a portion whose diameter is smaller than a volume having a diameter equivalent to 97%, concurrently a portion exceeding the outermost layer of aforesaid silver halide grains and concurrently a portion exceeding a portion occupied by aforesaid seed grain in aforesaid silver halide grains. Preferably, it is referred to as a portion whose diameter is smaller than a volume having a diameter equivalent to 90%, concurrently a portion exceeding the outermost layer of aforesaid silver halide grains and concurrently a portion exceeding a portion occupied by aforesaid seed grain in aforesaid silver halide grains. More preferably, it is referred to as a portion whose diameter is smaller than a volume having a diameter equivalent to 70%, concurrently a portion exceeding the outermost layer of aforesaid silver halide grains and concurrently a portion exceeding a portion occupied by aforesaid seed grain in aforesaid silver halide grains. Most preferably, a portion whose diameter is smaller than a volume having a diameter equivalent to 50%, concurrently a portion exceeding the outermost layer of aforesaid silver halide grains and concurrently a portion exceeding a portion occupied by aforesaid seed grain in aforesaid silver halide grains.

The inner portion of silver halide grains is referred to as, when a seed grain is not used for manufacturing aforesaid silver halide grains silver halide grains of the present invention is not grown continuously from the formation of nuclei, a portion whose diameter is smaller than a volume having a diameter equivalent to 97%, concurrently a portion exceeding the outermost layer of aforesaid silver halide grains and concurrently a portion exceeding a portion occupied by aforesaid seed grain in aforesaid silver halide grains. Preferably, it is referred to as a portion whose diameter is smaller than a volume having a diameter equivalent to 90%, concurrently a portion exceeding the outermost layer of aforesaid silver halide grains and concurrently a portion exceeding a portion occupied by aforesaid seed grain in aforesaid silver halide grains. More preferably, it is referred to as a portion whose diameter is smaller than a volume having a diameter equivalent to 70%, concurrently a portion exceeding the outermost layer of aforesaid silver halide grains and concurrently a portion exceeding a portion occupied by aforesaid seed grain in aforesaid silver halide grains. Most preferably, a portion whose diameter is smaller than a volume having a diameter equivalent to 50%, concurrently a portion exceeding the outermost layer of aforesaid silver halide grains and concurrently a portion exceeding a portion occupied by aforesaid seed grain in aforesaid silver halide grains.

The inner portions of the silver halide grains are concentratedly reduction-sensitized, so that the reduction-sensitized silver halide phases are formed in layers, and further the extent of the reduction sensitization is inclined or distributed through the diameter from the center of the grains toward the surface of the grains. The reduction sensitization phases of the inner portions of the silver halide grains indirectly contribute to the formation and maintenance of latent images on the surface of the silver halide grains but do not directly form the latent images.

So far, so-called internal shallow-trapped latent image type silver halide grains have been reported on, in which the sensitization nucleus is present near the surface of the grains, however, the sensitization nucleus itself forms latent images and is different from that of the invention in shape and in intent.

Generally, a method called silver ripening was conducted on so-called faces of silver halide grains such as the surface of the grains, the surface of the grains in the growing process or the surface of seed grains, however, the method of the invention is characterized in that the ripening is conducted on the silver halide grain phases.

It is preferable that the reduction sensitization in the invention is carried out while the inner portions of the grains are formed and the above-described high silver iodide content layers are formed.

The reduction sensitization in the invention is carried out by a method of adding a reducing agent to a protective colloid solution in which silver halide grains grow or by a method of ripening or growing the silver halide grains at a low pAg of not more than pH of 7.0 or at a high pH not less than 7.0, and may be conducted in combinations thereof.

As the reducing agent in the invention, thioureadioxide, ascorbic acid or its derivative, a stannous salt, a borane compound, a hydrazine derivative, formamidine sulfinic acid, a silane compound, an amine, a polyamine or a sulfite salt is used, and it is preferable to use thioureadioxide, ascorbic acid or its derivative or a stannous salt.

The reducing agent in the invention is used in an amount of preferably $10^{-2}$ to $10^{-8}$, and more preferably $10^{-3}$ to $10^{-7}$ per mol of silver halide.

When the reduction sensitization in the invention is carried out in the protective colloid solution in which silver halide grains grow at a low pAg not more than 7.0, the silver halide grains are preferably ripened or grown after incorporating a silver salt therein to adjust to a appropriate pAg. The silver salt is preferably a water soluble silver salt, and more preferably an aqueous silver nitrate solution. The pAg at ripening is properly not more than 7.0, and preferably 2.0 to 5.0. (Herein, the pAg value is a common logarithm of a reciprocal of Ag ion concentration.) When the reduction sensitization in the invention is carried out in the protective colloid solution in which silver halide grains grow at a high pH of not less than 7.0, the silver halide grains are preferably ripened or grown after incorporating an alkali agent to adjust to a appropriate pH. As the alkali agent sodium hydroxide, potassium hydroxide or ammonia is used, and an alkali agent other than ammonia is preferably used.

The reduction sensitization in the invention is most effectively carried out in the protective colloid solution at a high pH of not less than 7.0 in which the silver halide grains grow.

The reducing agent, a silver salt for reduction ripening or an alkali agent may be added instantaneously or in a specific period of time. In the latter case, they may be added at either a constant or an accelerated rate. Necessary amount may also be added at several times. They may be placed in the reaction vessel before addition of a soluble salt and/or a soluble halide compound, or may be added together with a halide compound as a soluble halide solution containing them or added independently of a soluble silver salt or halide compound.

The reduction sensitization in the invention is preferably carried out in the protective colloid solution at a pH of not less than 7.0 in which silver halide grains grow. The pH is preferably 7.5 to 11.0, and more preferably 8.0 to 10.0.

The invention is characterized in that the reduction sensitization is carried out at the time the inner portions of the grains are formed, however, it is preferable that the circumstances of the reduction sensitization are eliminated immediately after completion of the formation of the inner portions of the grains in view of fog prevention.

When the reduction sensitization in the invention is carried out in the protective colloid solution of a high pH of not less than 7.0 in which silver halide grains grow, the solution is preferably controlled to gradually lower the pH, in the process of shell formation, after formation of the inner portions of the grains, to pH 5.0–6.5 in the process from the completion of the silver halide grain growth to desalting. The pH of the solution is rapidly lowered immediately after formation of the inner portions of the grains to preferably 6.5, and more preferably 5.0–6.0. As an acid, acetic acid or nitric acid is preferably used.

When the reduction sensitization in the invention is carried out in the protective colloid solution of a low pAg of not more than 7.0 in which silver halide grains grow, it is preferable that pAg is restored to a normal pAg of usual grain formation range immediately after formation or ripening of the inner portions of the grains, and silver halide grain growth after formation of the inner portions is carried out.

When the reduction sensitization in the invention is carried out by addition of a reducing agent, it is preferable that the reducing agent is added immediately before formation of the inner portions of silver halide grains and is deactivated immediately after ripening or formation of the inner portions of the grains. In order to deactivate the reducing agent, the following oxidizing agent is preferably used.

Hydrogen peroxide (aqueous) and its adducts: $H_2O_2$, $NaBO_2$, $H_2O_2—3H_2O$, $2Na_2CO_3—3H_2O$, $Na_4P_2O_7$ or $2Na_2SO_4—H_2O_2—2H_2O$; peroxide salt: $K_2S_2O_3$, $K_2C_2O_3$, $K_4P_4O_3$, or $K_2[Ti(O_2)C_2O_4]—3H_2O$; peracetic acid, ozone, $I_2$, thiosulfonic acid.

In the invention the above oxidizing agent can be used for a purpose other than deactivation of the reducing agent.

The addition amount of the oxidizing agent is preferably $10^{-3}$ to $10^{-5}$ mol per mol of the reducing agent used, although varied due to kinds thereof, reduction sensitizing conditions, addition time of an oxidizing agent or addition conditions of an oxidizing agent.

The addition time of an oxidizing agent may be at any time in the course of preparing the silver halide emulsion. It can also be added before addition of reducing agent.

The oxidizing agent can be added to a silver halide emulsion as is general in the art. For example, the oxidizing agent can be added thereto as a solution dissolved in alcohols or as an aqueous solution.

When preparing a silver halide photographic emulsion relating to the invention, other optimum requirements than the above-mentioned may be selected with reference to JP OPI Publication Nos. 61-6643/1986, 61-14630/1986, 61-112142/1986, 62-157024/1987, 62-18556/1987, 63-92942/1988, 63-151618/1988, 63-163451/1988, 63-220238/1988 and 63-311244/1988.

A silver halide photographic emulsion of the invention is preferably applicable to a silver halide color photographic light-sensitive material.

A silver halide photographic emulsion of the invention may be physical, chemically and/or spectrally sensitized. An additive applicable to such a processing step as mentioned above is given in Research Disclosure Nos. 17643, 18716 and 308119 (hereinafter abbreviated to RD 17643, RD 18716 and RD 308119, respectively). The following table shows the paragraphs and pages of the RDs where the additives are given.

TABLE 1

| Additive | RD308119 | RD17643 | RD18716 |
|---|---|---|---|
| Chemical sensitizer | p. 996 III-A | p. 23 | p. 648 |
| Spectral sensitizer | p. 996 IV-A, B, C, D, H, I, J | pp. 23–24 | pp. 648–9 |
| Super-sensitizer | p. 996 IV-A-E, J | pp. 23–24 | pp. 648–9 |
| Antifoggant | p. 998 VI | pp. 24–25 | p. 649 |
| Stabilizer | p. 998 VI | pp. 24–25 | p. 649 |

Some well-known photographic additives applicable to the invention are also given in RD17643, RD18716 and RD308119. Table 2 shows the paragraphs and pages of the RDs where are relative to the additives given.

TABLE 2

| Additive | RD308119 | RD17643 | RD18716 |
|---|---|---|---|
| Color-stain preventive | p. 1002 VIII | p. 25 | p. 650 |
| Dye-image stabilizer | p. 1001 VII-J | p. 25 | |
| Whitening agent | p. 998 V | p. 24 | |
| UV-absorbent | p. 1003 VIII-C, XIII-C | pp. 25–26 | |
| Light-absorbent | p. 1003 VIII | pp. 25–26 | |
| Light scattering agent | p. 1003 VIII | | |
| Filter dye | p. 1003 VIII | pp. 25–26 | |
| Binder | p. 1003 IX | p. 26 | p. 651 |
| Antistatic agent | p. 1006 XIII | p. 27 | p. 650 |
| Layer hardener | p. 1004 X | p. 26 | p. 651 |
| Plasticizer | p. 1006 XII | p. 27 | p. 650 |
| Lubricant | p. 1006 XII | p. 27 | p. 650 |
| Activator.coating aid | p. 1005 XI | pp. 26–27 | p. 650 |
| Matting agent | p. 1007 XVI | | |
| Developing agent (contained in light-sensitive material) | p. 1011 XX-B | | |

When constituting a color photographic light-sensitive material of the invention, various types of couplers can be used in combination. The concrete examples thereof are given in the above-mentioned RD 17643 and RD 308119. Table 3 shows the paragraphs and pages of the RDs where are relative to the couplers given.

TABLE 3

| Coupler | RD308119 | RD17643 |
|---|---|---|
| Yellow coupler | p. 1001 VII-D | p. 25 VII-C/G |
| Magenta coupler | p. 1001 VII-D | p. 25 VII-C/G |
| Cyan coupler | p. 1001 VII-D | p. 25 VII-C/G |
| Colored coupler | p. 1002 VII-G | p. 25 VII-G |
| DIR coupler | p. 1002 VII-F | p. 25 VII-F |
| BAR coupler | p. 1002 VII-F | |
| Other useful group-releasable coupler | p. 1001 VII-F | |
| Alkali-soluble coupler | p. 1001 VII-E | |

When preparing a silver halide photographic light-sensitive material of the invention, an additive applicable thereto may be added in such a dispersion method as described in RD 308119, p. 1007, paragraph XIV.

In the invention, it is allowed to make use of such a support as mentioned in the foregoing RD 17643, p. 28, RD 18716, PP. 647–648 and RD 308119, p. 1009, paragraph XVII.

A silver halide photographic light-sensitive material of the invention may be provided with such an auxiliary layer as a filter layer and an intermediate layer described in, for example, the foregoing RD 308119, paragraph VII-K.

A silver halide photographic light-sensitive material of the invention may have various layer arrangements such as a normally arranged layer, a reversely arranged layer and a unit-arranged layer each described in RD 308119, paragraph VII-K.

A silver halide photographic light-sensitive material of the invention may be served as various color light-sensitive material typified by, for example, a color negative film for general or movie use, a color reversal film for slide or TV use, a color paper, a color positive film and a color reversal paper.

When a dye image is to be obtained by making use of a silver halide photographic light-sensitive material of the invention, a commonly well-known color development process may be carried out after making an exposure.

A light-sensitive material of the invention may be developed in such an ordinary process as described in RD 17643, pp. 28–29, RD 18716, p. 615 and RD 308119, paragraph XIX.

EXAMPLES

NOW, the invention will be concretely detailed by citing the following examples. However, the invention shall not be limited thereto.

Example 1

(Preparation of twinned crystal seed emulsion T-I)

In the following manner, a seed emulsion having two parallel twin planes was prepared.

| A. | |
|---|---|
| Ossein gelatin | 80.0 g |
| Potassium bromide | 47.4 g |
| A 20 wt % methanol solution of $HO(CH_2CH_2O)_m[CH(CH_3)CH_2O]_{19.8}(CH_2CH_2O)_nH$ (m + n = 9.77) | 0.24 ml |
| Add distilled water to make | 8000.0 ml |

-continued

| | |
|---|---|
| B. | |
| Silver nitrate | 1200.0 g |
| Add distilled water to make | 1600.0 ml |
| C. | |
| Ossein gelatin | 32.2 g |
| Potassium bromide | 790.0 g |
| Potassium iodide | 70.34 g |
| Add distilled water to make | 1600.0 ml |
| D. | |
| Aqueous ammonia | 470.0 ml |

Solutions B and C were added in a double-jet method by taking 7.7 minutes to solution A, while stirring at 40° C., so that nuclei were produced. In the course mentioned above, the pBr thereof was kept at 1.60.

Thereafter, taking 30 minutes, the temperature was lowered to 20° C. Further, solution D was added thereto by taking one minute and, successively, a ripening treatment was applied for 5 minutes. The pBr concentration in the ripening treatment was 0.03 mols/liter and the ammonia concentration was 0.66 mols/liter.

After completing the ripening treatment, the pH was adjusted to be 6.0 and a desalting treatment was carried out by an ordinary method. After completing the desalting treatment, an aqueous 10 wt % gelatin solution was added to the resulting emulsion and the mixture was stirred and dispersed at 60° C. for 30 minutes. Thereafter, distilled water was added, so that 5360 g of an emulsion was prepared.

When the resulting seed emulsion was observed through an electron microscope, the emulsion was proved to have two twin planes parallel with each other.

The seed emulsion was also proved that the average grain-diameter thereof was 0.217 μm and the grains each having two parallel twin planes occupied 75% of the whole grain (in a percentage of grain numbers).

(Preparation of comparative silver halide emulsion Em-1)

By making use of the following 7 kinds of solutions, comparative silver halide emulsion Em-1 was prepared.

| | |
|---|---|
| (Solution A-1) | |
| Ossein gelatin | 67.0 g |
| Distilled water | 3176.0 ml |
| A 20 wt % methanol solution of $HO(CH_2CH_2O)_m[CH(CH_3)CH_2O]_{19.8}(CH_2CH_2O)_nH$ (m + n = 9.77) | 1.25 ml |
| Seed emulsion (T-1) | 98.51 g |
| Add distilled water to make | 3500.0 ml |
| (Solution B-1) | |
| An aqueous 0.5N silver nitrate solution | 948 ml |
| (Solution C-1) | |
| Potassium bromide | 52.88 g |
| Ossein gelatin | 35.55 g |
| Add distilled water to make | 948 ml |
| (Solution D-1) | |
| An aqueous 3.5N silver nitrate solution | 4471 ml |
| (Solution E-1) | |
| Potassium bromide | 1862.2 g |
| Ossein gelatin | 200 g |
| Add distilled water to make | 4471 ml |
| (Solution F-1) | |
| A finely grained emulsion comprising 3 wt % of gelatin and silver iodide grains (having an average grain-diameter of 0.05 μm) (*) | 2465.5 g |

*Preparation process thereof is shown below:
Two thousand (2000) ml each of an aqueous solution containing silver nitrate in an amount of 7.06 mols and that containing potassium iodide in an amount of 7.06 mols were added to 5000 ml of a 6.0 wt % gelatin solution containing potassium iodide in an amount of 0.06 mols by taking 10 minutes. The pH in the course of forming the fine grains was controlled to be 2.0 by making use of nitric acid, and the temperature was controlled to be 40° C. After completing the grain formation, the pH was adjusted to be 6.0 by making use of an aqueous sodium carbonate solution. The finished weight of the resulting emulsion was 12.53 kg.

(Solution G-1)

An aqueous 1.75N potassium bromide solution

Solution A-1 was added to a reaction chamber and, while it was being stirred violently, solutions B-1 through solution F-1 were each added thereto by a double-jet method, in accordance with the combination shown in Table 4 so as to grow seed crystals. Thereby, a core/shell type silver halide emulsion was prepared.

In the preparation thereof, (1) the adding rate of solutions B-1, C-1 and F-1, (2) the adding rate of solutions D-1, E-1 and F-1 and (3) the adding rate of solutions D-1 and E-1 were each varied increasingly to time so as to meet the critical growth rate of the silver halide grains, respectively, and the adding rates were so suitably controlled as neither to produce any small grains other than the seed grains being grown nor to produce any polydispersion due to an Ostwald ripening.

Over the whole period of crystal growth, the temperature of the solution and the pAg thereof were controlled to be 75° C. and 8.8 in the reaction vessel, respectively. For controlling the pAg, solution G-1 was added if occasion demanded.

Table 4 shows the silver iodide contents (calculated values) of the silver halide phases at each point of time corresponding to the adding time in the reaction chamber.

After completing the growth of the grains, a desalting treatment was carried out in accordance with the manner described in JP Application No. 3-41314/1991. Thereafter, 1.19 liters of an aqueous 20 wt % gelatin solution was added and dispersed therein at 50° C. for 30 minutes. The dispersion was then controlled to have a pH of 5.80 and a pBr of 3.55, at 40° C.

TABLE 4

| Solution added | Time for adding the solution (in min.) | Silver amount added (in %) | Silver iodide content (in mol %) |
|---|---|---|---|
| (1) B-1, C-1, F-1 | 0.00 | 0.0 | 6.0 |
| | 12.50 | 1.0 | 8.4 |
| | 22.83 | 2.0 | 10.8 |
| | 30.98 | 3.0 | 13.2 |
| (2) D-1, E-1, F-1 | 30.99 | 3.0 | 13.2 |
| | 52.82 | 6.0 | 20.4 |
| | 76.69 | 10.0 | 30.0 |
| | 122.33 | 19.0 | 30.0 |
| | 150.56 | 25.0 | 30.0 |
| | 155.12 | 26.0 | 27.5 |
| | 176.38 | 31.0 | 15.1 |
| | 187.90 | 34.0 | 7.7 |
| (3) D-1, E-1 | 188.00 | 34.0 | 0.0 |
| | 210.46 | 47.0 | 0.0 |

TABLE 4-continued

| Solution added | Time for adding the solution (in min.) | Silver amount added (in %) | Silver iodide content (in mol %) |
|---|---|---|---|
| | 224.92 | 64.0 | 0.0 |
| | 233.55 | 78.0 | 0.0 |
| | 243.00 | 100.0 | 0.0 |

(Preparation of comparative silver halide emulsion Em-2)

Comparative silver halide emulsion (Em-2) was prepared in the same manner as in the preparation of the comparative silver halide emulsion (Em-1), except that the following solution F-2 was used in place of solution F-1, and that the silver iodide contents of the silver halide phases were each controlled at each point of time corresponding to the adding time of the reaction solutions, as shown in Table 5.

| (Solution F-2) | |
|---|---|
| A fine-grained emulsion comprising 3 wt % of gelatin and silver iodide grains (having an average grain-diameter of 0.05 μm) | 1510 g |

*The preparation process was carried out in the same manner as in the preparation of solution F-1 in the case of the comparative silver halide emulsion (Em-1).

TABLE 5

| Solution added | Time for adding the solution (in min.) | Silver amount added (in %) | Silver iodide content (in mol %) |
|---|---|---|---|
| (1) B-1, C-1, F-2 | 0.00 | 0.0 | 6.0 |
| | 11.39 | 1.0 | 6.7 |
| | 20.87 | 2.0 | 7.4 |
| | 29.06 | 3.0 | 8.1 |
| (2) D-1, E-1, F-2 | 29.07 | 3.0 | 8.1 |
| | 47.34 | 6.0 | 10.2 |
| | 67.39 | 10.0 | 13.0 |
| | 107.75 | 20.0 | 20.0 |
| | 128.46 | 25.0 | 20.0 |
| | 133.00 | 26.0 | 18.6 |
| | 153.94 | 31.0 | 11.8 |
| | 163.82 | 34.0 | 7.7 |
| (3) D-1, E-1 | 163.83 | 34.0 | 0.0 |
| | 183.42 | 47.0 | 0.0 |
| | 197.88 | 64.0 | 0.0 |
| | 206.50 | 78.0 | 0.0 |
| | 215.87 | 100.0 | 0.0 |

(Preparation of inventive silver halide emulsion Em-3)

In the preparation of comparative silver halide emulsion (Em-1), 1.19 liters of an aqueous 20 wt % gelatin solution was added after completing a desalting treatment. After dispersing the mixture at 50° C. for 15 minutes, the pBr thereof was adjusted to be 1.5 at 50° C. by making use of an aqueous 3.5N potassium bromide solution. The following solution H-1 was then added thereto with stirring at 50° C. by taking 30 seconds. Ten minutes after, solution I-1 was added by taking 30 seconds. Another 10 minutes after, solution J-1 was further added thereto by taking 30 minutes. Successively, the resulting mixture was stirred for 20 minutes and the pH and pBr thereof were then adjusted to be 5.80 and 3.55 at 40° C., respectively.

| (Solution H-1) | |
|---|---|
| A fine-grained emulsion comprising 3 wt % of gelatin and silver bromide grains (having an average grain-diameter of 0.04 μm) (**) | 0.212 mols |
| (Solution I-1) | |
| A fine-grained emulsion comprising 3 wt % of gelatin and silver bromide grains (having an average grain-diameter of 0.04 μm) (**) | 0.212 mols |
| (Solution J-1) | |
| A fine-grained emulsion comprising 3 wt % of gelatin and silver bromide grains (having an average grain-diameter of 0.04 μm) (**) | 0.212 mols |

**The preparation process will be shown below:
Two thousand (2000) ml each of an aqueous solution containing silver nitrate in an amount of 7.06 mols and that containing potassium bromide in an amount of 7.06 mols were added to 5000 ml of a 6.0 wt % gelatin solution containing potassium bromide in an amount of 0.06 mols by taking 10 minutes. The pH in the course of forming the fine grains was controlled to be 2.0 by making use of nitric acid, and the temperature was controlled to be 30° C. After completing the grain formation, the pH was adjusted to be 6.0 by making use of an aqueous sodium carbonate solution.

(Preparation of inventive silver halide emulsion Em-4)

In the preparation of comparative silver halide emulsion (Em-1), 1.19 liters of an aqueous 20 wt % gelatin solution was added after completing a desalting treatment. After dispersing the mixture at 50° C. for 15 minutes, the pBr thereof was adjusted to be 1.5 at 50° C. by making use of an aqueous 3.5N potassium bromide solution. The following solution H-2 was then constantly added thereto with stirring at 50° C. by taking 10 seconds. Successively, the resulting mixture was stirred for 20 minutes and the pH and pBr thereof were then adjusted to be 5.80 and 3.55 at 40° C., respectively.

| (Solution H-2) | |
|---|---|
| A fine-grained emulsion comprising 3 wt % of gelatin and silver bromide grains (having an average grain-diameter of 0.04 μm), that was prepared in the same manner as in the inventive silver halide emulsion (Em-3) | 1.02 mols |

(Preparation of inventive silver halide emulsion Em-5)

In the preparation of comparative silver halide emulsion (Em-1), 1.19 liters of an aqueous 20 wt % gelatin solution was added after completing a desalting treatment. After dispersing the mixture at 50° C. for 15 minutes, the pBr thereof was adjusted to be 1.5 at 50° C. by making use of an aqueous 3.5N potassium bromide solution. The following solution H-3 was then constantly added thereto with stirring at 50° C. by taking 10 seconds. Successively, the resulting mixture was stirred for 30 minutes and the pH and pBr thereof were then adjusted to be 5.80 and 3.55 at 40° C., respectively.

| (Solution H-3) | |
|---|---|
| A fine-grained emulsion comprising 3 wt % of gelatin and silver bromide grains (having an average grain-diameter | 1.27 mols |

-continued

| (Solution H-3) | |
|---|---|
| of 0.04 μm), that was prepared in the same manner as in the inventive silver halide emulsion (Em-3) | |

(Preparation of inventive silver halide emulsion Em-6)

In the preparation of comparative silver halide emulsion (Em-2), 1.19 liters of an aqueous 20 wt % gelatin solution was added after completing a desalting treatment. After dispersing the mixture at 50° C. for 15 minutes, the pBr thereof was adjusted to be 1.5 at 50° C. by making use of an aqueous 3.5N potassium bromide solution. The following solution H-4 was then constantly added thereto with stirring at 50° C. by taking 10 seconds. Successively, the resulting mixture was stirred for 20 minutes and the pH and pBr thereof were then adjusted to be 5.80 and 3.55 at 40° C., respectively.

| (Solution H-4) | |
|---|---|
| A fine-grained emulsion comprising 3 wt % of gelatin and silver bromide grains (having an average grain-diameter of 0.04 μm), that was prepared in the same manner as in the inventive silver halide emulsion (Em-3) | 0.89 mols |

(Preparation of inventive silver halide emulsion Em-7)

In the preparation of comparative silver halide emulsion (Em-2), 1.19 liters of an aqueous 20 wt % gelatin solution was added after completing a desalting treatment. After dispersing the mixture at 50° C. for 15 minutes, the pBr thereof was adjusted to be 1.5 at 50° C. by making use of an aqueous 3.5N potassium bromide solution. After stirring the dispersion at 50° C., solution H-1, that was used for preparing the inventive silver halide emulsion (Em-3), was then added thereto by taking 30 seconds. Ten minutes after, solution I-1 was added by taking 30 seconds. Another 10 minutes after, solution J-1 was further added thereto by taking 30 minutes. Successively, the resulting mixture was stirred for 20 minutes and the pH and pBr thereof were then adjusted to be 5.80 and 3.55 at 40° C., respectively.

(Preparation of comparative silver halide emulsion Em-8)

Comparative silver halide emulsion Em-8 was prepared in the same manner as in emulsion Em-1, except that after adding solutions D-1 and E-1, pBr of the mixture was adjusted to 1.5 at 50° C. with a 3.5N potassium bromide solution and then solution H-3 was added thereto over a period of 10 minutes, while stirring at 50° C. The resulting mixture was desalted in the same manner as in emulsion Em-1.

The features of the silver halide emulsions (Em-1) through (Em-8) will be shown in Table 6.

TABLE 6

| Emulsion | Invention or comparison | Crystal habit | Average grain-size (in μm) | Average aspect ratio | Distribution range (in %) | Maximum AgI content (in mol %) of AgI containing phase present in AgX grain | Average AgI content (in mol %) of AgX grain | AgI content (in mol %) in the neighborhood of the uppermost surface of AgX grain | Thickness (Å) of AgX phase including grain surface formed by supplying AgX fine grains |
|---|---|---|---|---|---|---|---|---|---|
| Em-1 | Comp. | Tabular-shaped | 1.23 | 2.0 | 14.0 | 30 | 8.0 | 5.4 | — |
| Em-2 | Comp. | Tabular-shaped | 1.32 | 2.5 | 13.0 | 20 | 4.9 | 4.9 | — |
| Em-3 | Inv. | Tabular-shaped | 1.24 | 2.0 | 14.0 | 30 | 7.7 | 4.0 | 50 |
| Em-4 | Inv. | Tabular-shaped | 1.25 | 2.0 | 14.0 | 30 | 7.6 | 2.1 | 80 |
| Em-5 | Inv. | Tabular-shaped | 1.26 | 2.0 | 14.0 | 30 | 7.5 | 1.2 | 100 |
| Em-6 | Inv. | Tabular-shaped | 1.34 | 2.5 | 13.0 | 20 | 4.7 | 2.0 | 70 |
| Em-7 | Inv. | Tabular-shaped | 1.33 | 2.5 | 13.0 | 20 | 4.7 | 3.1 | 50 |
| Em-8 | Comp. | Tabular-shaped | 1.26 | 2.0 | 14.0 | 30 | 7.5 | 5.2 | 100 |

Each of silver halide emulsions (Em-1) through (Em-8) was subjected to the optimum chemical sensitization. In the following formula, the resulting emulsions were collectively represented by (Emulsion D). By making use of Emulsion D, multilayered color light-sensitive material samples No. 101 through No. 108 were prepared.

On a triacetyl cellulose film support, the layers having the following compositions were formed one after another in the order from the support side.

| | |
|---|---|
| Layer 1 | |
| Alumina-sol AS-100 (aluminum oxide) (manufactured by Nissan Chemical Industries Co.) | 0.8 g |
| Layer 2 | |
| Diacetyl cellulose | 100 mg |
| Stearic acid | 10 mg |
| Fine-grained silica (having an average particle-size of 0.2 μm) | 50 mg |

(Preparation of silver halide color light-sensitive material)

Multilayered color light-sensitive material samples No. through No. 108 were prepared by arranging each layer having the following compositions to the top of the foregoing transparent support.

Composition of light-sensitive layer

The amounts of the materials coated thereon were shown, respectively; by an amount converted into the amount of metal silver in terms of a unit of g/m$^2$ for silver halide and colloidal silver; by an amount in terms of a unit of g/m$^2$ for additives; and by an amount of mols per mol of silver halide used in one and the same layer for sensitizing dyes.

Samples

| | |
|---|---|
| **Layer 1: An antihalation layer** | |
| Black colloidal silver | 0.16 |
| UV-absorbent (UV-1) | 0.20 |
| High-boiling solvent (OIL-1) | 0.16 |
| Gelatin | 1.60 |
| **Layer 2: An intermediate layer** | |
| Compound (SC-1) | 0.14 |
| High-boiling solvent (OIL-2) | 0.17 |
| Gelatin | 0.80 |
| **Layer 3: A low-speed red-sensitive layer** | |
| Silver iodobromide emulsion A | 0.15 |
| Silver iodobromide emulsion B | 0.35 |
| Sensitizing dye (SD-1) | $2.0 \times 10^{-4}$ |
| Sensitizing dye (SD-2) | $1.4 \times 10^{-4}$ |
| Sensitizing dye (SD-3) | $1.4 \times 10^{-5}$ |
| Sensitizing dye (SD-4) | $0.7 \times 10^{-4}$ |
| Cyan coupler (C-1) | 0.53 |
| Colored cyan coupler (CC-1) | 0.04 |
| DIR compound (D-1) | 0.025 |
| High-boiling solvent (OIL-3) | 0.48 |
| Gelatin | 1.09 |
| **Layer 4: A medium-speed red-sensitive layer** | |
| Silver iodobromide emulsion B | 0.30 |
| Silver iodobromide emulsion C | 0.34 |
| Sensitizing dye (SD-1) | $1.7 \times 10^{-4}$ |
| Sensitizing dye (SD-2) | $0.86 \times 10^{-4}$ |
| Sensitizing dye (SD-3) | $1.15 \times 10^{-5}$ |
| Sensitizing dye (SD-4) | $0.86 \times 10^{-4}$ |
| Cyan coupler (C-1) | 0.33 |
| Colored cyan coupler (CC-1) | 0.013 |
| DIR compound (D-1) | 0.02 |
| High-boiling solvent (OIL-3) | 0.16 |
| Gelatin | 0.79 |
| **Layer 5: A high-speed red-sensitive layer** | |
| Emulsion D | 0.95 |
| Sensitizing dye (SD-1) | $1.0 \times 10^{-4}$ |
| Sensitizing dye (SD-2) | $1.0 \times 10^{-4}$ |
| Sensitizing dye (SD-3) | $1.2 \times 10^{-5}$ |
| Cyan coupler (C-2) | 0.14 |
| Colored cyan coupler (CC-1) | 0.016 |
| High-boiling solvent (OIL-1) | 0.16 |
| Gelatin | 0.79 |
| **Layer 6: An intermediate layer** | |
| Compound (SC-1) | 0.09 |
| High-boiling solvent (OIL-2) | 0.11 |
| Gelatin | 0.80 |
| **Layer 7: A low-speed green-sensitive layer** | |
| Silver iodobromide emulsion A | 0.12 |
| Silver iodobromide emulsion B | 0.38 |
| Sensitizing dye (SD-4) | $4.6 \times 10^{-5}$ |
| Sensitizing dye (SD-5) | $4.1 \times 10^{-4}$ |
| Magenta coupler (M-1) | 0.14 |
| Magenta coupler (M-2) | 0.14 |
| Colored cyan coupler (CM-1) | 0.06 |
| High-boiling solvent (OIL-4) | 0.34 |
| Gelatin | 0.70 |
| **Layer 8: An intermediate layer** | |
| Gelatin | 0.41 |
| **Layer 9: A medium-speed green-sensitive layer** | |
| Silver iodobromide emulsion B | 0.30 |
| Silver iodobromide emulsion C | 0.34 |
| Sensitizing dye (SD-6) | $1.2 \times 10^{-4}$ |
| Sensitizing dye (SD-7) | $1.2 \times 10^{-4}$ |
| Sensitizing dye (SD-8) | $1.2 \times 10^{-4}$ |

-continued

| | |
|---|---|
| Magenta coupler (M-1) | 0.04 |
| Magenta coupler (M-2) | 0.04 |
| Colored magenta coupler (CM-1) | 0.017 |
| DIR compound (D-2) | 0.025 |
| DIR compound (D-3) | 0.002 |
| High-boiling solvent (OIL-4) | 0.12 |
| Gelatin | 0.50 |
| **Layer 10: A high-speed green-sensitive layer** | |
| Emulsion D | 0.95 |
| Sensitizing dye (SD-6) | $7.1 \times 10^{-5}$ |
| Sensitizing dye (SD-7) | $7.1 \times 10^{-5}$ |
| Sensitizing dye (SD-8) | $7.1 \times 10^{-5}$ |
| Magenta coupler (M-1) | 0.09 |
| Colored magenta coupler (CM-1) | 0.011 |
| High-boiling solvent (OIL-4) | 0.11 |
| Gelatin | 0.79 |
| **Layer 11: A yellow filter layer** | |
| Yellow colloidal silver | 0.08 |
| Compound (SC-1) | 0.15 |
| High-boiling solvent (OIL-2) | 0.19 |
| Gelatin | 1.10 |
| **Layer 12: A low-speed blue-sensitive layer** | |
| Silver iodobromide emulsion A | 0.12 |
| Silver iodobromide emulsion B | 0.24 |
| Silver iodobromide emulsion C | 0.12 |
| Sensitizing dye (SD-9) | $6.3 \times 10^{-5}$ |
| Sensitizing dye (SD-10) | $1.0 \times 10^{-5}$ |
| Yellow coupler (Y-1) | 0.50 |
| Yellow coupler (Y-2) | 0.50 |
| DIR compound (D-4) | 0.04 |
| DIR compound (D-5) | 0.02 |
| High-boiling solvent (OIL-2) | 0.42 |
| Gelatin | 1.40 |
| **Layer 13: A high-speed blue-sensitive layer** | |
| Silver iodobromide emulsion C | 0.15 |
| Silver iodobromide emulsion E | 0.80 |
| Sensitizing dye (SD-9) | $8.0 \times 10^{-5}$ |
| Sensitizing dye (SD-11) | $3.1 \times 10^{-5}$ |
| Yellow coupler (Y-1) | 0.12 |
| High-boiling solvent (OIL-2) | 0.05 |
| Gelatin | 0.79 |
| **Layer 14: Protective layer 1** | |
| Silver iodobromide emulsion (having an average grain-diameter of 0.08 μm & a silver iodide content of 1.0 mol %) | 0.40 |
| UV-absorbent (UV-1) | 0.065 |
| High-boiling solvent (OIL-1) | 0.07 |
| High-boiling solvent (OIL-3) | 0.07 |
| Gelatin | 0.65 |
| **Layer 15: Protective layer 2** | |
| Alkali-soluble matting agent (having an average particle-size of 2 μm) | 0.15 |
| Polymethyl methacrylate (having an average particle-size of 3 μm) | 0.04 |
| Lubricant (WAX-1) | 0.04 |
| Gelatin | 0.55 |

Besides the above-given compositions, coating aid Su-1, dispersing aid Su-2, a thickener hardeners H-1 and H-2, stabilizer ST-1, antifoggants AF-1 having an average molecular weight of 10,000 and AF-2 having that of 1,100,000, and preservative DI-1 were each added to the sample.

The emulsions applied to the above-mentioned sample were as follows. The average grain-diameters thereof will be shown by the grain-diameters each converted into a cube. Each of the emulsions was subjected to the optimum gold-sulfur sensitization.

TABLE 7

| Emulsion used | Average AgI content (in mol %) | Average grain-diameter (in μm) | Crystal habit | Ratio of grain-diameter/grain thickness |
|---|---|---|---|---|
| Emulsion A | 4.0 | 0.30 | Regular crystal | 1 |
| Emulsion B | 6.0 | 0.42 | Regular crystal | 1 |
| Emulsion C | 6.0 | 0.55 | Regular crystal | 1 |
| Emulsion E | 6.0 | 0.95 | Tabular-shaped twinned crystal | 4 |

For the first coating, layer 1 through layer 8 were coated on the sample at the same time by making use of a multislide hopper type coater and, for the second coating, layer 9 through layer 16 were coated on the first coated layers also at the same time by making use of the above-mentioned coater. Sample 101 was proved to have an amount of silver coated of 6.25 g/m$^2$, a dried layer thickness of 18 μm and a specific photographic sensitivity of 420.

C-1

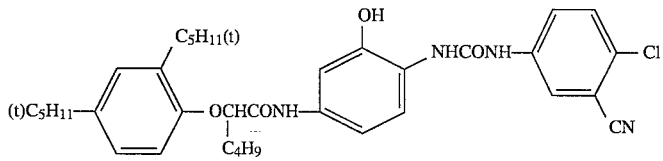

C-2

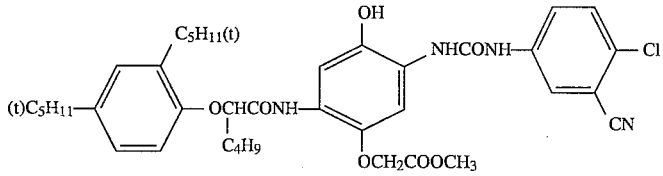

M-1

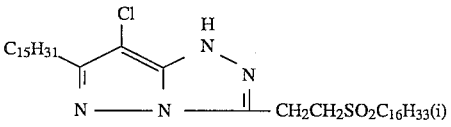

M-2

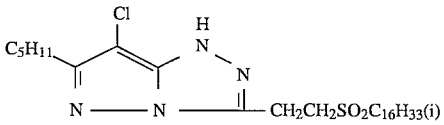

M-3

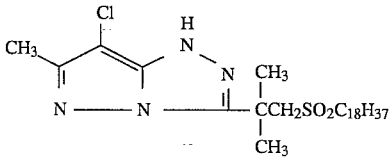

M-4

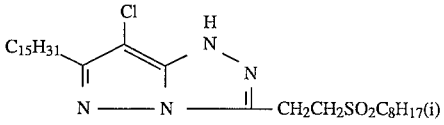

M-5

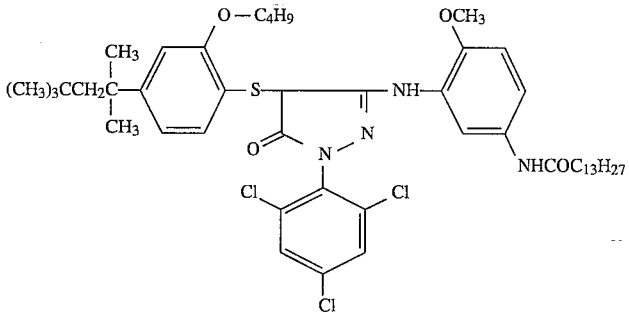

-continued
Y-1
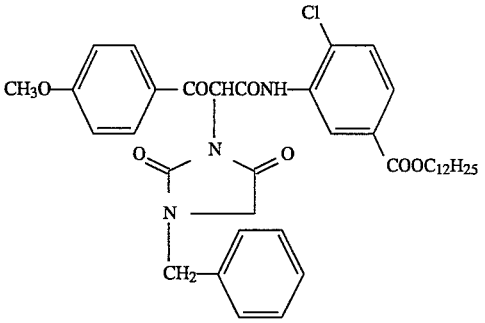
Y-2
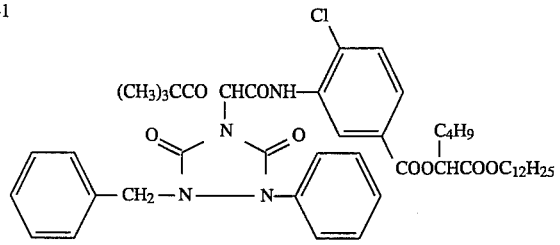
CC-1
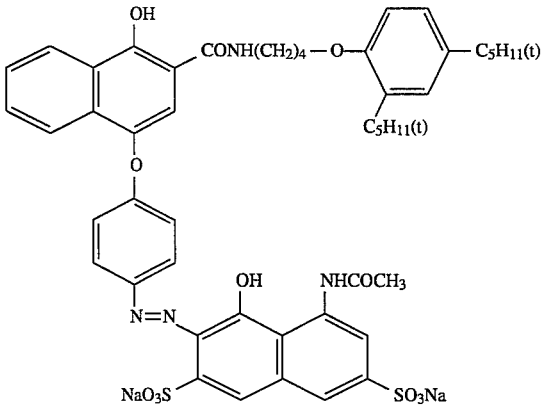
CM-1
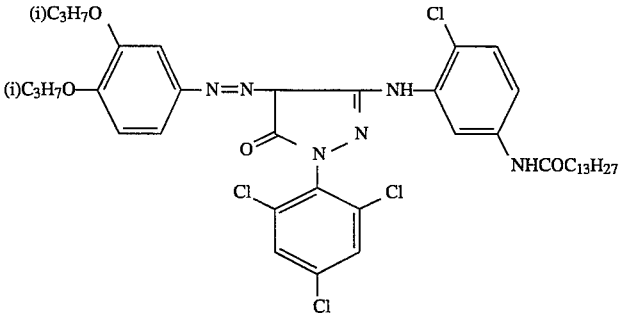
CM-2
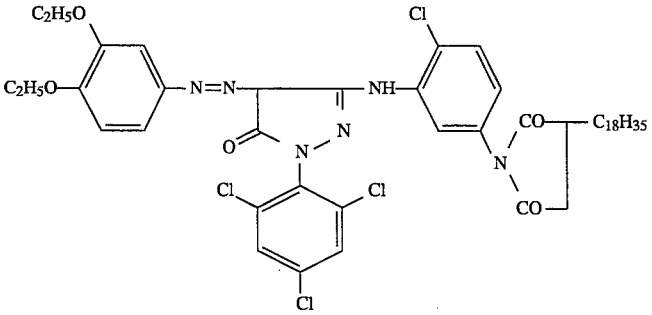

-continued
D-1
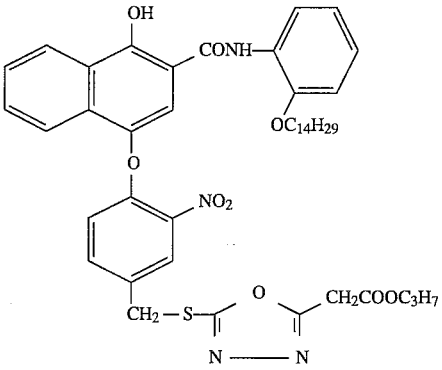
D-2
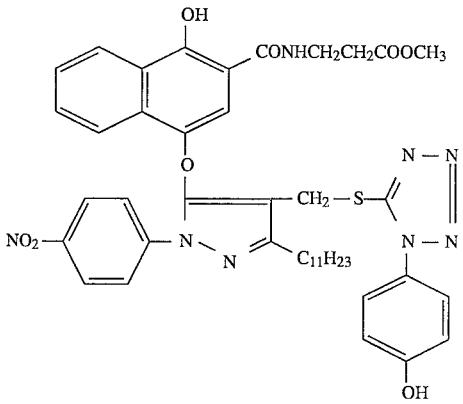
D-3
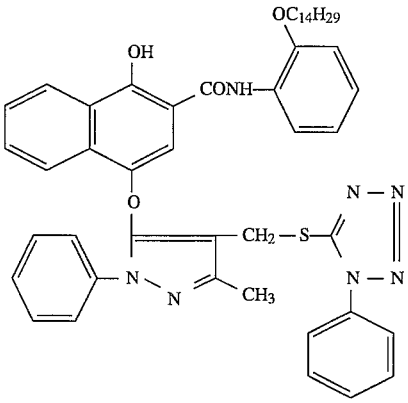
D-4
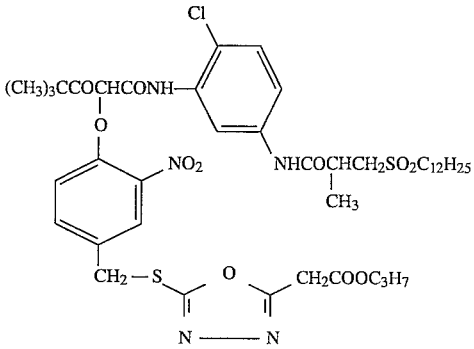
D-5
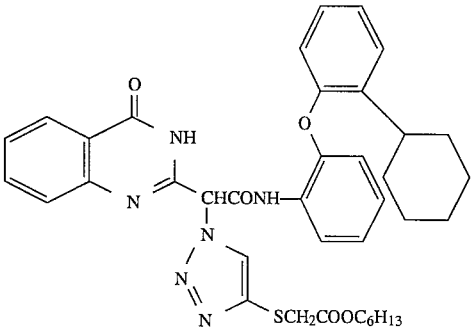
D-6
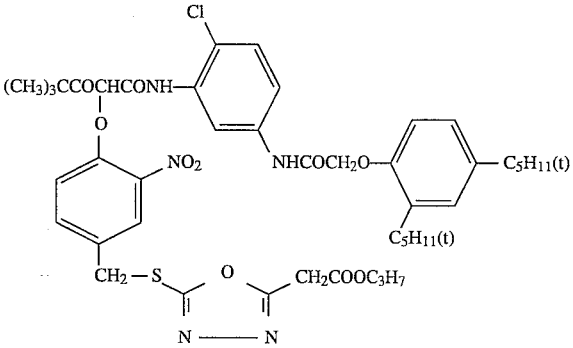
OIL-1
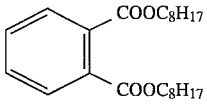
OIL-2
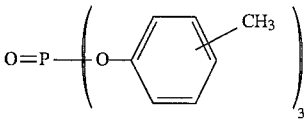

-continued
OIL-3
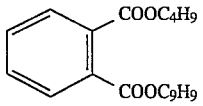
OIL-4
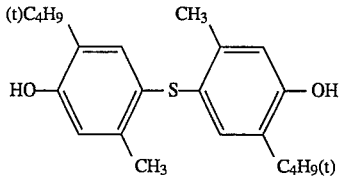
OIL-5
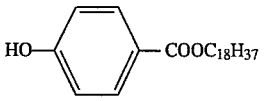
SC-1
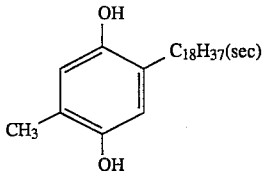
UV-1
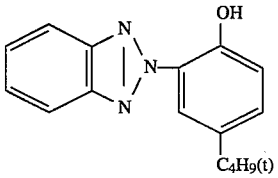
WAX-1
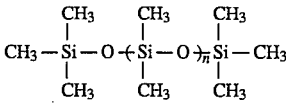
(Weight average molecular weight Mw = 3,000)
Su-1
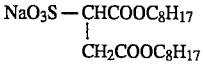
Su-2
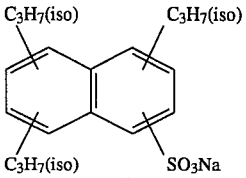
SD-1
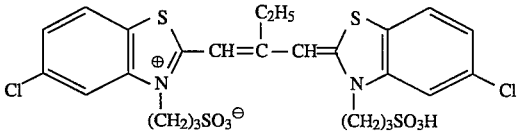
SD-2
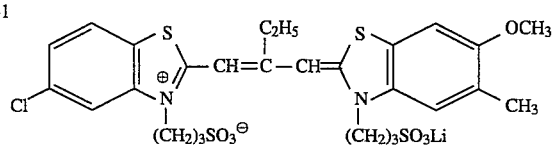
SD-3
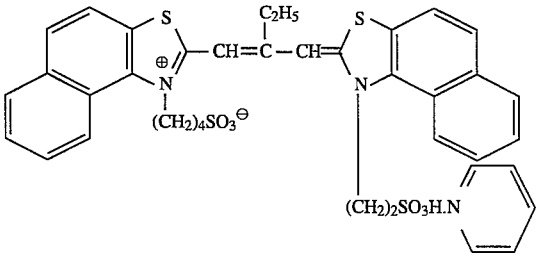
SD-4
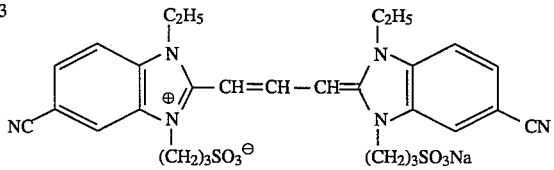
SD-5
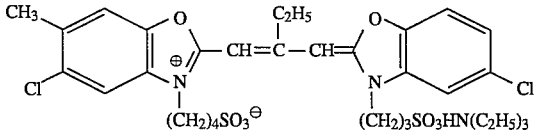
SD-6
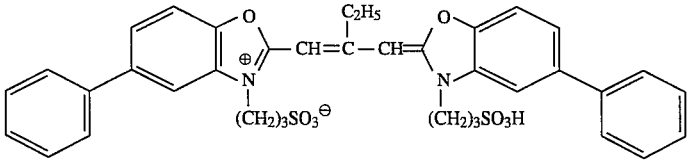

-continued

SD-7

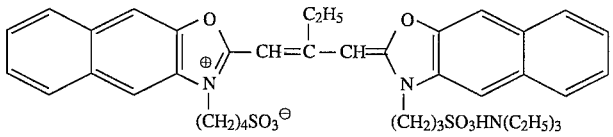

SD-8

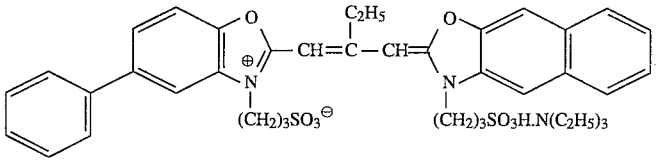

SD-9

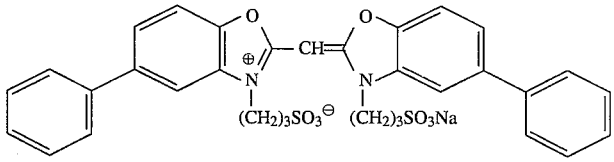

SD-10

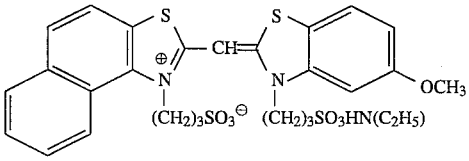

SD-11

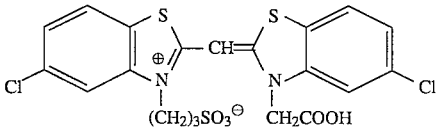

H-1

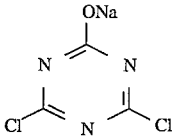

H-2

$(CH_2{=}CHSO_2CH_2)_2O$

ST-1

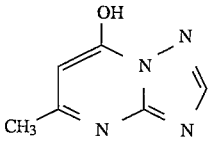

AF-1

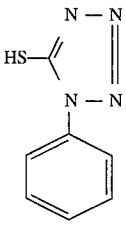

AF-2

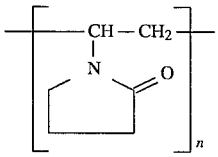

n: Polymerization degree

DI-1

(Mixture of the following 3 components)

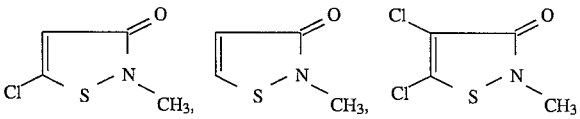

(Component A) (Component B) (Component C)

Component A:Component B:Component C = 50:46:4 (in mol ratio)

The resulting samples were exposed to white light for sensitometry and were then processed in the following processing steps. The resulting sensitivities and RMS graininess thereof were evaluated.

Processing steps carried out at 38° C.

| | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

In the above-mentioned processing steps, the compositions of the processing solutions used therein were as follows.

| | |
|---|---|
| (Color developer) | |
| 4-amino-3-methyl-N-ethyl-N-(β-hydroxyethyl)-aniline.sulfate | 4.75 g |
| Sodium sulfite anhydrous | 4.25 g |
| Hydroxylamine-1/2 sulfate | 2.0 g |
| Potassium carbonate anhydrous | 37.5 g |
| Sodium bromide | 1.3 g |
| Trisodium nitrilotriacetate (monohydrate) | 2.5 g |
| Potassium hydroxide | 1.0 g |
| Add water to make | 1 liter |
| Adjust pH to be | pH = 10.0 |
| (Bleaching solution) | |
| Iron-ammonium ethylenediamine tetraacetate | 100.0 g |
| Diammonium ethylenediamine tetraacetate | 10.0 g |
| Ammonium bromide | 150.0 g |
| Glacial acetic acid | 10.0 g |
| Add water to make | 1 liter |
| Adjust pH with aqueous ammonia to be | pH = 6.0 |
| (Fixing solution) | |
| Ammonium thiosulfate | 175.0 g |
| Sodium sulfite anhydrous | 8.5 g |
| Sodium metasulfite | 2.3 g |
| Add water to make | 1 liter |
| Adjust pH with acetic acid to be | pH = 6.0 |
| (Stabilizing solution) | |
| Formalin (in an aqueous 37% solution) | 1.5 ml |
| Konidux (manufactured by Konica Corp.) | 7.5 ml |
| Add water to make | 1 liter |

Sensitivity (S) was represented by a value relative to the reciprocal of a quantity of light necessary for providing a density of a fog density plus 0.1. The sensitivities of each sample were indicated by a value relative to the green sensitivity of sample No. 101, that was regarded as a value of 100.

The above-mentioned RMS graininess was a value 1,000 time as much as the standard deviation of the variation of a density value produced when a density of the minimum density plus 1.0 was scanned by making use of a microdensitometer having an aperture scanning area of 250 $\mu m^2$. The values thereof were indicated by a value relative to the RMS value of sample No. 101, that was regarded as a value of 100.

Table 8 shows the values relative to the evaluation results on the sensitivities and the RMS graininess of coated samples No. 101 through No. 107 in which (Em-1) through (Em-8) were used respectively.

TABLE 8

| Sample No. | Emulsion No. | Samples for | Relative sensitivity | RMS value (in relative value) |
|---|---|---|---|---|
| 101 | Em-1 | Comparison | 100 | 100 |
| 102 | Em-2 | Comparison | 97 | 97 |
| 103 | Em-3 | Invention | 114 | 93 |
| 104 | Em-4 | Invention | 122 | 90 |
| 105 | Em-5 | Invention | 125 | 92 |
| 106 | Em-6 | Invention | 118 | 90 |
| 107 | Em-7 | Invention | 113 | 93 |
| 108 | Em-8 | Comparison | 99 | 99 |

From the contents of Table 8, it was proved that samples No. 101 through No. 107 applied with silver halide photographic emulsions (Em-3) through (Em-7) were excellent in the relative sensitivities as compared to those of samples No. 101 and No. 102 applied with comparative emulsions (Em-1) and (Em-2), and that the RMS values thereof could also be more excellent in RMS values than in those applied with the comparative emulsions, respectively.

Example 2

By making use of the following 7 kinds of solutions, comparative silver halide emulsion (Em-9) comprising octahedral monodisperse type silver halide grains without having any twinned crystal planes was prepared.

| | |
|---|---|
| (Solution A-2) | |
| Ossein gelatin | 268.2 g |
| Distilled water | 4.0 liters |
| A 20 wt % methanol solution of $HO(CH_2CH_2O)_m[CH(CH_3)CH_2O]_{19.8}(CH_2CH_2O)_nH$ (in which m + n = 9.77) | 0.75 ml |
| Seed emulsion (a silver iodobromide emulsion having a uniform silver iodide content of 2 mol % in the grains thereof and an average grain-diameter of 0.428 μm) | 0.341 mols |
| An aqueous 28 wt % ammonia solution | 528.0 ml |
| An aqueous 56 wt % acetic acid solution | 795.0 ml |
| A methanol solution containing iodine in an amount of 0.001 mols | 50.0 ml |
| Add distilled water to make | 5930.0 ml |
| (Solution B-2) | |
| An aqueous 3.5N ammoniacal silver nitrate solution (provided, the pH was adjusted to be 9.0 with ammonium nitrate) | |
| (Solution C-2) | |
| An aqueous 3.5N potassium bromide solution containing gelatin in an amount of 4.0 wt % | |
| (Solution D-2) | |
| A fine-grained emulsion comprising gelatin in an amount of 3 wt % and silver iodide grains (having an average grain-size of 0.05 μm)*** | 0.844 mols |

***The preparation procedures will be given below:
Two-thousand (2,000) ml each of an aqueous solution containing silver nitrate in an amount of 7.06 mols and an aqueous solution containing potassium iodide in an amount of 7.06 mols were added to 5000 ml of a 6.0 wt % gelatin solution containing potassium iodide in an amount of 0.06 mols by taking 10 minutes. The pH thereof and the temperature each in the course of forming the fine grains was controlled to be 2.0 and 40° C., respectively. After completing the grain formation, the pH was adjusted to be 6.0 by making use of an aqueous sodium carbonate solution.

(Solution E-2)

A fine-grained emulsion comprising silver bromide grains (having an average grain-diameter of 0.04 μm), that was prepared in the same manner as in the silver iodide fine-grained emulsion described in solution D-2 2.20 ml (Solution F-3)

An aqueous 1.75N potassium bromide solution (Solution G-2)

An aqueous 56 wt % acetic acid solution

Solutions B-2, C-2 and D-2 were added at the same time to solution A-2 that was put in a reaction chamber and kept at 70° C. by a mixing method by taking 163 minutes and, successively, solution E-2 was then constantly added independently by taking 12 minutes, so that the seed crystals were grown up to be 1.349 μm.

The adding rate of solutions B-2 and C-2 were each varied functionwise according to time so as to correspond to the critical growth rate of the silver halide grains, and the solutions were added at the suitable adding rates so as neither to produce any small grains other than the seed grains being grown nor to produce any polydispersion due to an Ostwald ripening. Solution D-2, that was a silver iodide fine-grained emulsion, was supplied by varying the adding rate thereof to an aqueous ammoniacal silver nitrate solution so as to correspond to the grain-diameter (or the adding time) as shown in Table 9, so that a core/shell type silver halide emulsion having a multiple-layered structure could be prepared.

By making use of solutions F-3 and G-2, the pAg and pH in the course of growing the crystals were controlled as shown in Table 9. The pAg and pH were measured by making use of a silver sulfide electrode and a glass electrode in an ordinary method.

After completing the grain formation and in accordance with the method described in JP Application No. 3-41314/1991, a desalting treatment was carried out, and gelatin was then added and dispersed. Thereafter, the pH and pBr were adjusted to be 5.80 and 3.55 at 40° C., respectively.

TABLE 9

| | Adding time (in min.) | Grain-diameter (in μm) | Flow rate of solution D | pH | pAg |
|---|---|---|---|---|---|
| Inter-mediate layer | 0.0 | 0.428 | 10.3 | 7.2 | 7.8 |
| | 23.1 | 0.584 | 10.3 | 7.2 | 7.8 |
| | 38.0 | 0.669 | 10.3 | 7.2 | 7.8 |
| Core | 50.1 | 0.726 | 30.0 | 7.2 | 7.8 |
| | 82.6 | 0.887 | 30.0 | 7.2 | 7.8 |
| | 82.6 | 0.887 | 30.0 | 6.5 | 9.4 |
| Shell | 112.7 | 0.952 | 10.3 | 6.5 | 9.4 |
| | 122.0 | 0.976 | 10.3 | 6.5 | 9.4 |
| | 141.6 | 1.054 | 7.7 | 6.5 | 9.4 |
| | 141.6 | 1.054 | 0.0 | 6.5 | 9.4 |
| | 163.0 | 1.249 | 0.0 | 6.5 | 9.7 |

(Preparation of silver halide emulsion Em-10 of the invention)

In the preparation of comparative silver halide emulsion (Em-9), 0.7 liters of an aqueous 20 wt % gelatin solution was added after completing a desalting treatment. After dispersing the resulting mixture for 15 minutes at 50° C., the pBr was adjusted to be 1.3 at 50° C. with an aqueous 3.5N potassium bromide solution. While stirring it at 50° C., the following solution H-5 was added for 30 seconds and the resulting mixture was stirred for 10 minutes and the pH and pBr thereof were then adjusted to be 5.80 and 3.55 at 40° C., respectively.

(Solution H-5)

A fine-grained emulsion comprising 3 wt % of gelatin and silver bromide fine grains (having a grain-diameter of 0.04 μm), that was prepared in the same manner as in solution E-2 in the preparation of comparative emulsion (E m-9) 0.229 mols (Preparation of silver halide emulsion Em-11 of the invention)

In the preparation of comparative silver halide emulsion (Em-9), 0.7 liters of an aqueous 20 wt % gelatin solution was added after completing a desalting treatment. After dispersing the resulting mixture for 15 minutes at 50° C., the pBr was adjusted to be 1.3 at 50° C. with an aqueous 3.5N potassium bromide solution. While stirring it at 50° C., the following solution H-6 was constantly added for 10 seconds and, successively, the resulting mixture was stirred for 20 minutes. The pH and pBr thereof were then adjusted to be 5.80 and 3.55 at 40° C., respectively.

(Solution H-6)

This solution was prepared in the same manner as in solution E-2 in the preparation of comparative emulsion (Em-9).

A fine-grained emulsion comprising 3 wt % of gelatin and silver bromide fine grains (having a grain-diameter of 0.04 μm) 0.382 mols (Preparation of silver halide emulsion Em-12 of the invention)

In the preparation of comparative silver halide emulsion (Em-9), 0.7 liters of an aqueous 20 wt % gelatin solution was added after completing a desalting treatment. After dispersing the resulting mixture for 15 minutes at 50° C., the pBr was adjusted to be 1.3 at 50° C. with an aqueous 3.5N potassium bromide solution. While stirring it at 50° C., the following solution H-7 was constantly added by taking 10 seconds and, successively, the resulting mixture was stirred for 20 minutes. The pH and pBr thereof were then adjusted to be 5.80 and 3.55 at 40° C., respectively.

(Solution H-7)

This solution was prepared in the same manner as in solution E-2 in the preparation of comparative emulsion (Em-8).

A fine-grained emulsion comprising 3 wt % of gelatin and silver bromide fine grains (having a gain-size of 0.04 μm) 0.764 mols The characteristics of silver halide emulsions (Em-9) through (Em-12) will be shown in Table 10.

TABLE 10

| Emul-sion | Inven-tion or com-parison | Crystal habit | Average grain-size (in μm) | Aver-age aspect ratio | Distri-bution range (in %) | Maximum AgI content (in mol %) of AgI con-taining phase present in AgX grain | Average AgI content (in mol %) of AgX grain | AgI content (in mol %) in the neighborhood of the uppermost sur-face of AgX grain | Thickness (Å) of AgX phase includ-ing grain surface formed by supply-ing AgX fine grains |
|---|---|---|---|---|---|---|---|---|---|
| Em-9 | Comp. | Octa-hedron | 1.349 | — | 10.5 | 30 | 8.0 | 6.3 | — |
| Em-10 | Inv. | Octa-hedron | 1.355 | — | 10.5 | 30 | 7.9 | 4.3 | 30 |

TABLE 10-continued

| Emulsion | Invention or comparison | Crystal habit | Average grain-size (in μm) | Average aspect ratio | Distribution range (in %) | Maximum AgI content (in mol %) of AgI containing phase present in AgX grain | Average AgI content (in mol %) of AgX grain | AgI content (in mol %) in the neighborhood of the uppermost surface of AgX grain | Thickness (Å) of AgX phase including grain surface formed by supplying AgX fine grains |
|---|---|---|---|---|---|---|---|---|---|
| Em-11 | Inv. | Octahedron | 1.359 | — | 10.5 | 30 | 7.8 | 3.2 | 50 |
| Em-12 | Inv. | Octahedron | 1.369 | — | 10.5 | 30 | 7.6 | 2.7 | 100 |

By making use of silver halide photographic emulsions (Em-9) through (Em-12), multilayered color photographic light-sensitive material samples No. 109 through No. 112 were prepared in the same manner as in example 1. In the same manner, the resulting sensitivity and RMS graininess thereof were evaluated according to the values relative to that of sample No. 109 that was regarded as a value of 100. The results thereof will be shown in Table 11.

TABLE 11

| Sample No. | Emulsion No. | Samples for | Relative sensitivity | RMS value (in relative value) |
|---|---|---|---|---|
| 109 | Em-9 | Comparison | 100 | 100 |
| 110 | Em-10 | Invention | 112 | 96 |
| 111 | Em-11 | Invention | 120 | 95 |
| 112 | Em-12 | Invention | 122 | 96 |

It was proved from the contents of Table 11 that samples No. 110 through No. 112 applied with silver halide photographic emulsions-(Em-10) through (Em-12) of the invention excellently resulted in sensitivity and graininess, as compared to the sample No. 109 applied with comparative emulsion (Em-9).

Example 3

Preparation of twinned seed emulsion (T-1)

In reference to description of Japanese Patent Application No. 341164/1991, a seed emulsion (T-1) having two parallel twin plane was prepared by the following method.

| | |
|---|---|
| (Solution A) | |
| Ossein gelatin | 80.0 g |
| Potassium bromide | 47.4 g |
| $HO(CH_2CH_2O)_m(CHCH_3CH_2O)_{19.8}(CH_2CH_2O)_nH$ (m + n = 9.77) (10 weight % methanol solution) | 0.48 g |
| Water was added to make 8000 ml in total. | |
| (Solution B) | |
| Silver nitrate | 1200 g |
| Water was added to make 1600 ml in total. | |
| (Solution C) | |
| Ossein gelatin | 32.2 g |
| Potassium bromide | 790 g |
| Potassium iodide | 70.34 g |
| Water was added to make 1600 ml in total. | |
| (Solution D) | |
| Aqueous ammonia | 470 ml |

To Solution A subjected to vigorous stirring at 40 ° C., Solutions B and C were added in 7.7 minutes by means of a double jet method using a stirring apparatus described in Japanese Patent Publication Open to Public Inspection No. 160128/1987 for producing nucleus. During this process, pBr was kept at 1.60.

After that, the temperature was reduced to 20 ° C. over the course of 35 minutes. In addition, Solution D was added for 1 minute. Then, Succeedingly, the resulting solution was subjected to ripening for 5 minutes. During ripening, a KBr concentration was 0.03 mol/l and an ammonia concentration was 0.66 mol/l.

After the ripening was finished, pH was adjusted to 6.0 and the solution was subjected to desalting in accordance with a conventional method. When the seed emulsion grains were observed through an electron microscope, it was found that the average grain size of the seed emulsion grains was 0.225 μm and the proportion of grains having two-parallel twin planes was 75% by number based upon the total grains.

Preparation of Comparative emulsion (Em-13)

A comparative emulsion (Em-13) was prepared by the use of the following 5 kinds of solutions.

| | |
|---|---|
| (Solution A-1) | |
| Ossein gelatin | 66.5 g |
| Distilled water | 3227 ml |
| $HO(CH_2CH_2O)_m(CHCH_3CH_2O)_{19.8}(CH_2CH_2O)_nH$ | 2.50 ml |
| (m + n = 9.77) (10 weight % methanol solution) | 98.5 g |
| Seed emulsion (T-1) | |
| Water was added to make 3500 cc in total. | |
| (Solution B-1) | |
| 3.5 N silver nitrate aqueous solution | 4702.0 ml |
| (Solution C-1) | |
| Potassium bromide | 2499.0 g |
| Distilled water was added to make 6000 cc in total. | |
| (Solution D-1) | |
| Fine grain emulsion comprised of 3% by weight of gelatin and silver iodide grains (an average grain size is 0.05 μm) | 1897.0 g |

The emulsion was prepared in a manner as follows.

Two thousand milliliters of each of an aqueous solution containing 7.06 mols of silver nitrate and an aqueous solution containing 7.06 mols of potassium iodide were added to 5000 ml of a 6.0 wt % gelatin solution containing 0.06 mols of potassium iodide for 10 minutes. The temperature in the course of forming the fine grains was kept at 40° C. The finished weight was 12.53 kg.

(Solution E-1)

1.75N potassium bromide aqueous solution

To a reacting vessel, Solution A-1 was added. While stirring vigorously, Solutions B-1 through D-1 were added by a double jet method in accordance with combination as described in Table 1. Then, seed crystals were grown so that a core/shell type silver halide emulsion was prepared.

The addition rates of (1) solution B-3, solution C-3 and solution D-3 and (2) solution B-3 and solution C-3) were acceleratedly varied over time so as to meet the critical growth rate of the respective silver halide grains wherein the solutions were added at a suitable adding rates so that any small-sized grains other than the growing seed crystals may not be produced and may not be poly-dispersed by the Ostwald ripening phenomenon.

The emulsion in the reaction vessel was controlled to be 75° C. and pAg 8.8 in the overall course of the grain growth. Solution E-3 was optionally added to control pAg. Though pH was not controlled, it was regulated from 5.0 to 6.0 during growth of grains.

The added silver amount and silver iodide content of the silver halide phase formed at the time the solutions were added are shown in Table 1.

After grain growth, the emulsion was subjected to desalting according to the method described in Japanese Patent Application No. 4-59351, mixed with 1.19 liter of an aqueous 20 weight % gelatin solution, dispersed at 50° C. for 30 minutes, adjusted to pH 5.80 and pBr 3.55 at 40° C.

The silver halide grains in the obtained emulsion were mono-disperse tabular silver halide grains having an average grain size of 1.34 μm (based on averaged areas of irregular two-dimensional projected areas), an average aspect ratio of 2.6 and a grain size distribution of 18%.

TABLE 12

| Added solution | Time in which solutions were added (min.) | Silver weight added (%) | Silver iodide content (mol %) |
|---|---|---|---|
| (1)B-1, C-1, D-1 | 0.00 | 0.0 | 10.0 |
| (1)B-1, C-1, D-1 | 30.99 | 3.0 | 10.0 |
| (1)B-1, C-1, D-1 | 52.47 | 6.0 | 10.0 |
| (1)B-1, C-1, D-1 | 76.48 | 10.0 | 10.0 |
| (1)B-1, C-1, D-1 | 76.48 | 10.0 | 30.0 |
| (1)B-1, C-1, D-1 | 117.30 | 18.0 | 30.0 |
| (1)B-1, C-1, D-1 | 150.13 | 25.0 | 30.0 |
| (1)B-1, C-1, D-1 | 150.13 | 25.0 | 10.0 |
| (1)B-1, C-1, D-1 | 176.09 | 31.0 | 10.0 |
| (2)B-1, C-1 | 176.09 | 31.0 | 0.0 |
| (2)B-1, C-1 | 209.51 | 50.0 | 0.0 |
| (2)B-1, C-1 | 221.07 | 64.0 | 0.0 |
| (2)B-1, C-1 | 230.68 | 80.0 | 0.0 |
| (2)B-1, C-1 | 239.00 | 100.0 | 0.0 |

(Preparation of Emulsion (Em-14) of the present invention)

Emulsion of the present invention (Em-14) was prepared in the same manner as in comparative emulsion (Em-13), except that the following was conducted; the emulsion was adjusted to pH 8.0 using an aqueous 10% sodium hydroxide solution 52.47 minutes after addition of solutions B-1 through D-1 had begun. After the growth of grains, the emulsion was subjected to desalting according to a method described in Japanese Patent Application No. 4-59351, mixed with 1.19 liter of an aqueous weight % gelatin solution, dispersed at 50° C. for 15 minutes, adjusted to pBr 1.5 at 50° C. with a 3.5N potassium bromide solution, and the following solution H-O was added thereto over 30 seconds under stirring, followed by another 20 minutes stirring. The resulting emulsion was adjusted to pH 5.80 and pBr 3.55 at 40° C. The pH of the emulsion in the reacting vessel was as follows:

| | | | | | |
|---|---|---|---|---|---|
| Time after addition of solutions B-1 through D-1 began (minute) | 52.47 | 76.48 | 150.13 | 176.09 | 239.00 |
| pH of the emulsion in the vessel (Solution H-0) | 8.00 | 7.51 | 6.40 | 6.36 | 5.84 |
| Fine grain emulsion composed of gelatin of 3 weight % and silver bromoiodide grains (an average grain size of 0.04 μm) | | | | | 0.212 mol |

The emulsion was prepared in a manner as follows.

Two thousand milliliters of each of an aqueous solution containing 7.06 mols of silver nitrate and an aqueous solution containing 7.06 mols of potassium iodide were added to 5000 ml of a 6.0 wt % gelatin solution containing 0.06 mols of potassium iodide in 10 minutes. The temperature in the course of forming the fine grains was kept at 30° C. During forming fine grains, pH was regulated to 3.0 using nitric acid, and then, pH was regulated to 6.0 using an aqueous sodium carbonate solution.

(Preparation of Emulsion (Em-15) of the present invention)

Emulsion of the present invention (Em-15) was prepared in the same manner as in comparative emulsion (Em-13), except that the following was conducted: the emulsion was adjusted to pH 9.0 using an aqueous 10% potassium hydroxide solution 52.47 minutes after addition of solutions B-1 through D-1 had begun. After the growth of grains, the emulsion was subjected to desalting according to the method described in Japanese Patent Application No. 4-59351, mixed with 1.19 liter of an aqueous 20 weight % gelatin solution, dispersed at 50° C. for 15 minutes, adjusted to pBr 1.5 at 50° C. with a 3.5N potassium bromide solution, and the following solution H-O was added thereto over 30 seconds while stirring, followed by another 20 minutes' stirring. The resulting emulsion was adjusted to pH 5.80 and pBr 3.55 at 40° C. The pH of the emulsion in the reacting vessel was as follows:

| | | | | | |
|---|---|---|---|---|---|
| Time after addition of solutions B-1 through D-1 began | 52.47 | 76.48 | 150.13 | 176.09 | 239.00 |
| pH of the emulsion in the vessel | 8.00 | 8.43 | 7.16 | 6.89 | 6.32 |

(Preparation of Emulsion (Em-16) of the present invention)

Emulsion of the present invention (Em-16) was prepared in the same manner as in comparative emulsion (Em-13), except that the following was conducted: the emulsion was adjusted to pH 9.0 using an aqueous 10% potassium hydroxide solution 52.47 minutes after addition of solutions B-1 through D-1 had begun and, in addition, the emulsion was adjusted to pH 6.0 using acetic acid 150.13 minutes after addition of solutions B-1 through D-1 had begun. After the growth of the grains, the emulsion was subjected to desalting according to the method described in Japanese Patent Application No. 4-59351, mixed with 1.19 liter of an aqueous 20 weight % gelatin solution, dispersed at 50° C. for 15 minutes, adjusted to pBr 1.5 at 50° C. with a 3.5N potassium bromide solution, and the following solution H-O used in the preparation of (Em-14) was added thereto over 30 seconds while stirring, followed by another 20 minutes of stirring. The resulting emulsion was adjusted to pH 5.80 and pBr 3.55 at 40° C. The pH of the emulsion in the reacting vessel was as follows:

| | | | | | | |
|---|---|---|---|---|---|---|
| Time after addition of solutions B-1 through D-1 began | 52.47 | 76.48 | 150.13 | →150.13 | 176.09 | 239.00 |
| pH of the emulsion in the vessel | 9.00 | 8.46 | 7.22 | 6.00 | 5.94 | 6.32 |

(Preparation of Emulsion (Em-17) of the present invention)

Emulsion of the present invention (Em-17) was prepared in the same manner as in comparative emulsion (Em-13), except that the following was conducted. The addition of Solutions B-1 through D-1 was discontinued 52.47 minutes after the addition, pAg was regulated to 6.0 using 3.5N silver nitrate aqueous solution, pAg was returned to 8.8 using 3.5N potassium bromide aqueous solution after 10 minutes of ripening, addition of Solutions B-1 through D-1 was started again, and then, the emulsion was adjusted to pH 6.0 using acetic acid 150.13 minutes after addition of solutions B-1 through D-1 had begun and, in addition, the emulsion was adjusted to pH 6.0 using acetic acid 150.13 minutes after addition of solutions B-1 through D-1 had begun. After the growth of the grains, the emulsion was subjected to desalting according to the method described in Japanese Patent Application No. 4-59351, mixed with 1.19 liter of an aqueous 20 weight % gelatin solution, dispersed at 50° C. for 15 minutes, adjusted to pBr 1.5 at 50° C. with a 3.5N potassium bromide solution, and the following solution H-O in the preparation of (Em-14) was added thereto over 30 seconds while stirring, followed by another 20 minutes of stirring. The resulting emulsion was adjusted to pH 5.80 and pBr 3.55 at 40° C.

(Preparation of Emulsion (Em-18) of the present invention)

Emulsion of the present invention (Em-18) was prepared in the same manner as in comparative emulsion (Em-13), except that addition of Solutions B-1 through D-1 was interrupted 52.47 minutes after the addition, pAg was regulated to 5.0 using 3.5N silver nitrate aqueous solution, pAg was returned to 8.8 using 3.5N potassium bromide aqueous solution after 10 minutes of ripening, addition of Solutions B-1 through D-1 was started again, and then, the emulsion was adjusted to pAg 5.0 using 3.5N silver nitrate aqueous solution, and then, pAg was returned to 8.8 with 3.5N potassium bromide aqueous solution 10 minutes after ripening and addtion of Solutions B-1 through D-1 was restarted. After completing the growth of grains, the emulsion was subjected to desalting according to a method described in Japanese Patent Application No. 4-59351, mixed with 1.19 liter of an aqueous 20 weight % gelatin solution, dispersed at 50° C. for 15 minutes, adjusted to pBr 1.5 at 50° C. with a 3.5N potassium bromide solution, and the following solution H-O was added thereto over 30 seconds under stirring, followed by another 20 minutes of stirring. The resulting emulsion was adjusted to pH 5.80 and pBr 3.55 at 40° C.

Table 14 shows the characteristics of emulsions (Em-13) through (Em-18).

TABLE 14

| Emulsion Nos. | Category | Average grain size | Average grain aspect ratio | Average grain size distribution (%) | Average silver iodide content of the surface of grains $I_1$: (mol %) | Average silver iodide content of grains $I_2$: (mol %) | Average silver iodide content of high iodide content of the inner portions of grains (mol %) | Reduction sensitization method | Portions reduction sensitized | Shapes of grains | Ammonium compound | The ratio of a projected area occupied by tabular grains to that of the total grains |
|---|---|---|---|---|---|---|---|---|---|---|---|---|
| Em-13 | Comp. | 1.34 | 2.6 | 18 | 5.0 | 6.1 | 30 | — | — | Tabular | None | 86 |
| Em-14 | Inv. | 1.35 | 2.6 | 16 | 3.1 | 6.0 | 30 | pH 8.0 | Core-shell | Tabular | None | 85 |
| Em-15 | Inv. | 1.37 | 2.7 | 18 | 3.2 | 6.0 | 30 | pH 9.0 | Core-shell | Tabular | None | 82 |
| Em-16 | Inv. | 1.34 | 2.5 | 15 | 3.1 | 6.0 | 30 | pH 9.0 | Core | Tabular | None | 87 |
| Em-17 | Inv. | 1.35 | 2.6 | 18 | 3.0 | 5.9 | 30 | pH 6.0 | Core | Tabular | None | 88 |
| Em-18 | Inv. | 1.37 | 2.6 | 16 | 3.0 | 5.8 | 30 | pH 5.0 | Core | Tabular | None | 86 |

Emulsions (Em-13) through (Em-18) were respectively subjected to the most suitable chemical sensitization. These emulsions were respectively used in the following formulation for samples under the name of (Emulsion A).

On a triacetyl cellulose film support, each layer having the following composition was formed from the support side succeedingly so that multilayered color photographic light-sensitive materials Nos. 201 through 206 were prepared. Weights added represent gram number per $m^2$ unless otherwise specificed specificly. Silver halide and colloidal silver were described in conversion to silver. Sensitizing dyes were described in terms of mol number per mol of silver.

| | |
|---|---|
| Layer 1: An antihalation layer | |
| Black colloidal silver | 0.16 |
| UV absorbent (UV-1) | 0.20 |
| High boiling organic solvent (Oil-1) | 0.16 |
| Gelatin | 1.23 |
| Layer 2: An intermediate layer | |
| Compound (SC-1) | 0.15 |
| High boiling organic solvent (Oil-2) | 0.17 |
| Gelatin | 1.27 |
| Layer 3: A low-speed red-sensitive layer | |
| Silver iodobromide emulsion (having an average grain size of 0.38 μm and a silver iodide content of 8.0 mol %) | 0.50 |
| Silver iodobromide emulsion (having an average grain size of 0.27 μm and a silver iodide content of 2.0 mol %) | 0.21 |
| Sensitizing dye (SD-1) | $2.8 \times 10^{-4}$ |
| Sensitizing dye (SD-2) | $1.9 \times 10^{-4}$ |

-continued

| | |
|---|---|
| Sensitizing dye (SD-3) | $1.9 \times 10^{-5}$ |
| Sensitizing dye (SD-4) | $1.0 \times 10^{-4}$ |
| Cyan coupler (C-1) | 0.48 |
| Cyan coupler (C-2) | 0.14 |
| Colored cyan coupler (CC-1) | 0.021 |
| DIR compound (D-1) | 0.020 |
| High boiling solvent (Oil-1) | 0.53 |
| Gelatin | 1.30 |
| Layer 4: A medium-speed red-sensitive layer | |
| Silver iodobromide emulsion (having an average grain size of 0.52 μm and a silver iodide content of 8.0 mol %) | 0.62 |
| Silver iodobromide emulsion (having an average grain size of 0.38 μm and a silver iodide content of 8.0 mol %) | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling solvent (Oil-1) | 0.30 |
| Gelatin | 0.93 |
| Layer 5: A high-speed red-sensitive layer | |
| Silver iodobromide emulsion (EM-13) | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (Oil-1) | 0.14 |
| Gelatin | 0.91 |
| Layer 6: An intermediate layer | |
| Compound (SC-1) | 0.09 |
| High boiling organic solvent (Oil-2) | 0.11 |
| Gelatin | 0.80 |
| Layer 7: A low-speed green-sensitive layer | |
| Silver iodobromide emulsion (having an average grain size of 0.38 μm and a silver iodide content of 8.0 mol %) | 0.61 |
| Silver iodobromide emulsion (having an average grain size of 0.27 μm and a silver iodide content of 2.0 mol %) | 0.20 |
| Sensitizing dye (SI)-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling solvent (Oil-2) | 0.75 |
| Gelatin | 1.95 |
| Layer 8: A medium-speed green-sensitive layer | |
| Silver iodobromide emulsion (having an average grain size of 0.59 μm and a silver iodide content of 8.0 mol %) | 0.87 |
| Sensitizing dye (SD-6) | $2.4 \times 10^{-4}$ |
| Sensitizing dye (SD-7) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| DIR compound (D-2) | 0.002 |
| High boiling solvent (Oil-2) | 0.50 |
| Gelatin | 1.00 |
| Layer 9: A high-speed green-sensitive layer | |
| Silver iodobromide emulsion (having an average grain size of 1.00 μm and a silver iodide content of 8.0 mol %) | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.084 |
| Magenta coupler (M-3) | 0.064 |

-continued

| | |
|---|---|
| Colored magenta coupler (CM-1) | 0.012 |
| High boiling solvent (Oil-1) | 0.27 |
| High boiling solvent (Oil-2) | 0.012 |
| Gelatin | 1.00 |
| Layer 10: A yellow filter layer | |
| Yellow colloidal silver | 0.08 |
| Color-stain inhibitor (SC-2) | 0.15 |
| Formalin scavenger (HS-1) | 0.20 |
| High boiling solvent (Oil-2) | 0.19 |
| Gelatin | 1.10 |
| Layer 11: An intermediate layer | |
| Formalin scavenger (HS-1) | 0.20 |
| Gelatin | 0.60 |
| Layer 12: A low-speed blue-sensitive layer | |
| Silver iodobromide emulsion (having an average grain size of 0.27 μm and a silver iodide content of 2.0 mol %) | 0.22 |
| Silver iodobromide emulsion (having an average grain size of 0.27 μm and a silver iodide content of 2.0 mol %) | 0.03 |
| Sensitizing dye (SD-8) | $4.9 \times 10^{-4}$ |
| Yellow coupler (Y-1) | 0.75 |
| DIR compound (D-1) | 0.010 |
| High boiling solvent (Oil-2) | 0.30 |
| Gelatin | 1.20 |
| Layer 13: A medium-speed blue-sensitive layer | |
| Silver iodobromide emulsion (having an average grain size of 0.59 μm and a silver iodide content of 8.0 mol %) | 0.30 |
| Sensitizing dye (SD-8) | $1.6 \times 10^{-4}$ |
| Sensitizing dye (SD-9) | $7.2 \times 10^{-5}$ |
| Yellow coupler (Y-1) | 0.10 |
| DIR compound (D-1) | 0.010 |
| High boiling solvent (Oil-2) | 0.046 |
| Gelatin | 0.47 |
| Layer 14: A high-speed blue-sensitive layer | |
| Silver iodobromide emulsion (having an average grain size of 1.00 μm and a silver iodide content of 8.0 mol %) | 0.85 |
| Sensitizing dye (SD-8) | $7.3 \times 10^{-5}$ |
| Sensitizing dye (SD-9) | $2.8 \times 10^{-5}$ |
| Yellow coupler (Y-1) | 0.11 |
| High boiling solvent (Oil-2) | 0.046 |
| Gelatin | 0.80 |
| Layer 15: Protective layer 1 | |
| Silver iodobromide emulsion (having an average grain size of 0.08 μm and a silver iodide content of 1.0 mol %) | 0.40 |
| UV absorbent (UV-1) | 0.065 |
| UV absorbent (UV-2) | 0.10 |
| High boiling solvent (Oil-1) | 0.07 |
| High boiling solvent (Oil-3) | 0.07 |
| Formalin scavenger (HS-1) | 0.40 |
| Gelatin | 1.31 |
| Layer 16: Protective layer 2 | |
| Alkali-soluble matting agent (having an average particle size of 2 μm) | 0.15 |
| Polymethyl methacrylate (having an average particle size of 3 μm) | 0.04 |
| Lubricant (WAX-1) | 0.04 |
| Gelatin | 0.55 |

Besides the above-given compositions, there were added with coating aid Su-1, dispersing aid Su-2, a viscosity controller, layer hardeners H-1 and H-2, stabilizer ST-1, two kinds of antifoggants AF-1 and AF-2 having the weight average molecular weights of 10,000 and 1,100,000, respectively, and antiseptic DI-1. The amount of DI-1 added was 9.4 mg/m$^2$.

The structures of the compounds applied to the resulting samples were as follows.
C-1
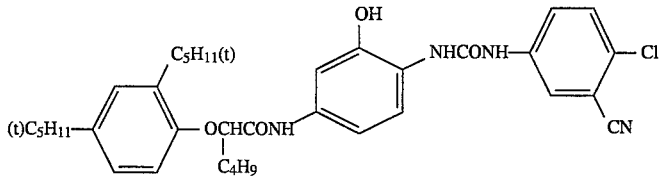
C-2
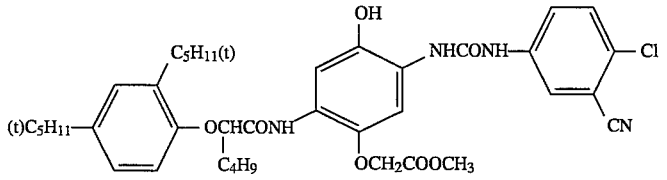
M-1
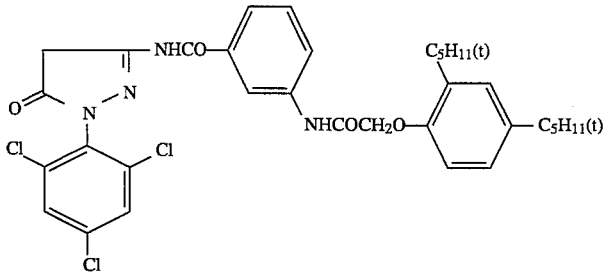
M-2
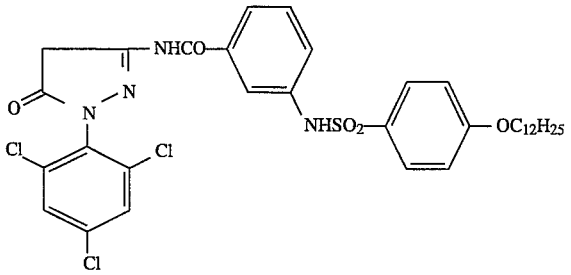
M-3
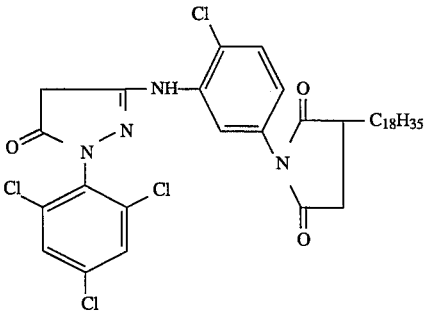
Y-1
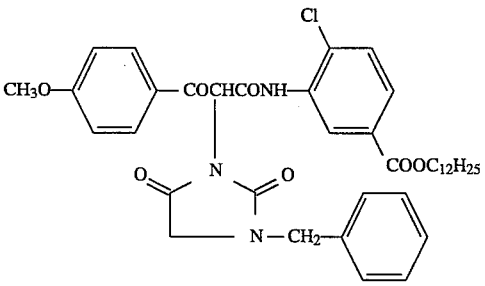
CM-1
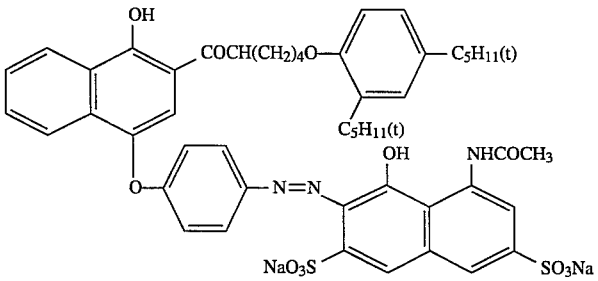

-continued
CM-1
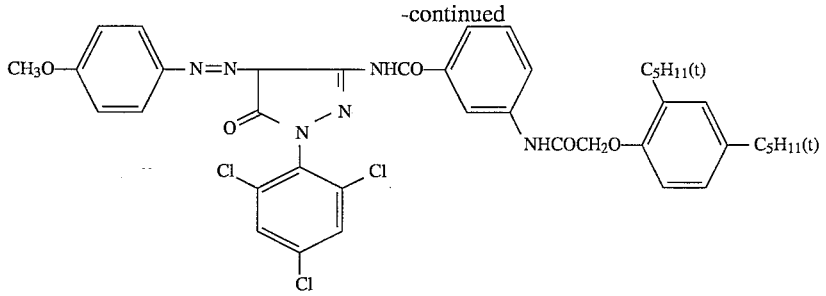
D-1
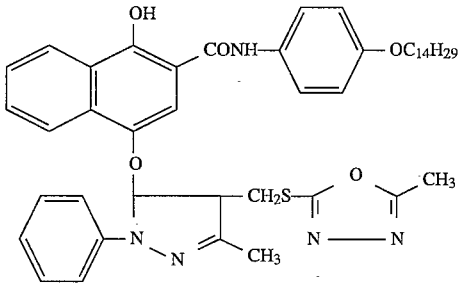
D-2
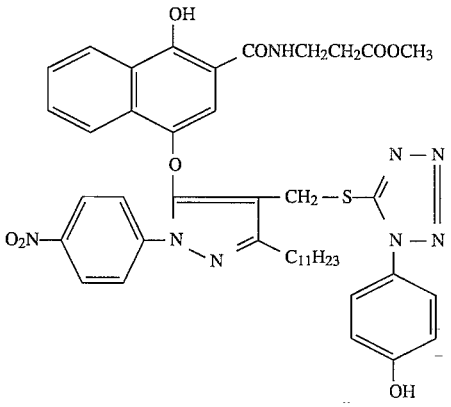
D-3
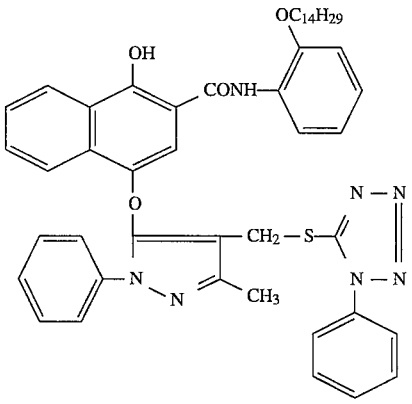
Oil-1
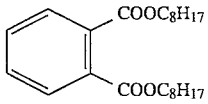
Oil-2
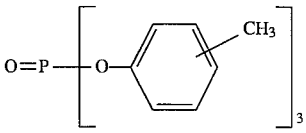
Oil-3
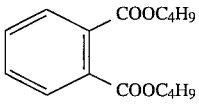
SC-1
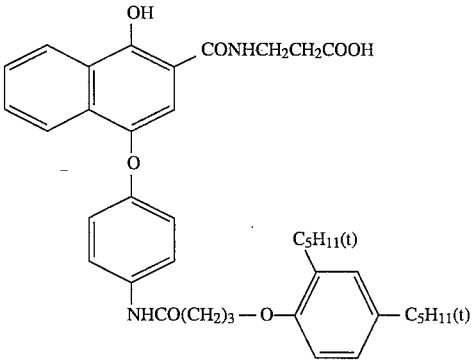
SC-2
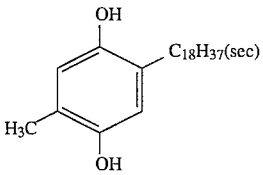

-continued
UV-1
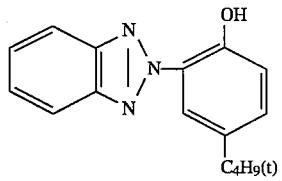
UV-2
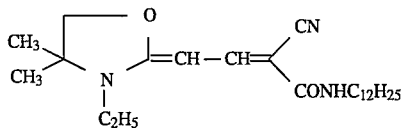
WAX-1
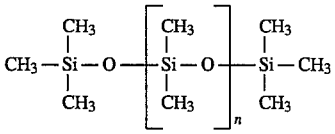
Weight average molecular weight MW: 3,000
Su-1
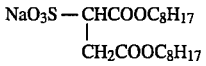
Su-2
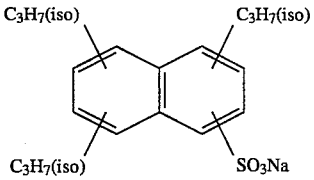
HS-1
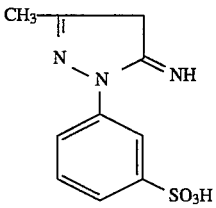
SD-1
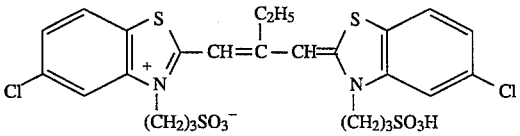
SD-2
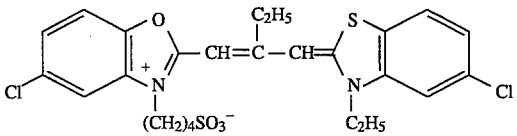
SD-3
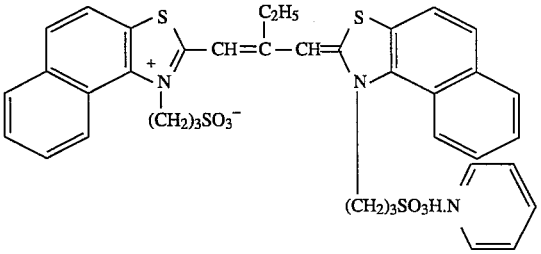
SD-4
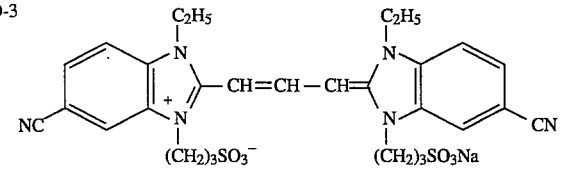
SD-5
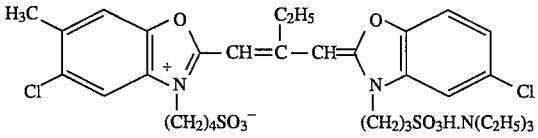
SD-6
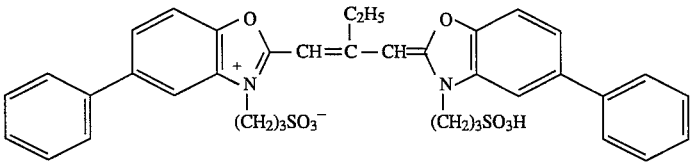
SD-7
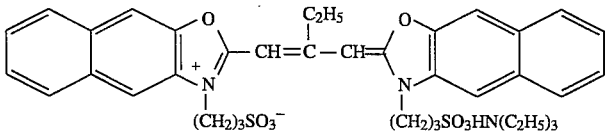
SD-8
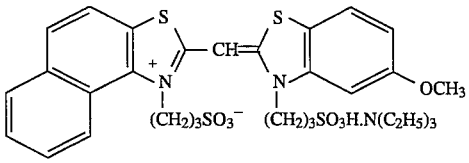

-continued

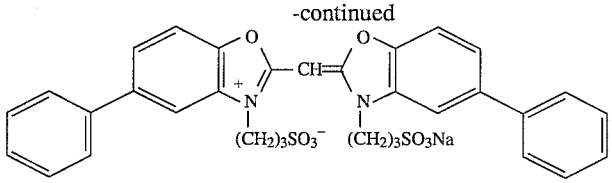

SD-9

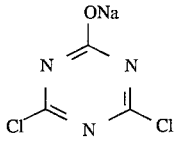

H-1

$(CH_2{=}CHSO_2CH_2)_2O$

H-2

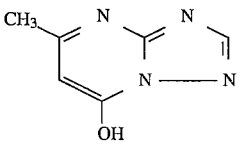

ST-1

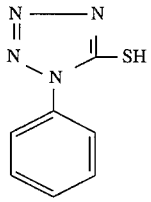

AF-1

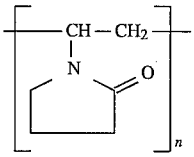

n: polymerization degree

AF-2

(A mixture of the following 3 components)

DI-1

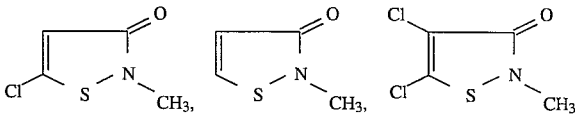

(Component A) (Component B) (Component C)

Components A:B:C = 50:46:4 (in mol ratio)

After the resulting samples were each exposed wedgewise to white light, they were stored under the following two kinds of conditions A and B. They were then subjected to the following processing steps and evaluated with respect to sensitivity and RMS graininess. In addition, the samples, immediately after exposed wedgewise to white light, were processed and evaluated.

| (Conditions) | |
|---|---|
| A: 40° C. | 3 days under 20% RH |
| B: 23° C. | 14 days under 50% RH |
| Processing steps (38° C.) | |
| 1. Color developing | 3 min. 15 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 1 min. 15 sec. |
| 7. Drying | |

The compositions of the processing solutions used in each of the processing steps were as follows.

| | |
|---|---|
| <Color developer> | |
| 4-amino-3-methyl-N-ethyl-N-(β-hydroxyethyl)aniline-sulfate | 4.75 g |
| Sodium sulfite, anhydrous | 4.25 g |
| Hydroxylamine.½sulfate | 2.0 g |
| Potassium carbonate, anhydrous | 37.5 g |
| Sodium bromide | 1.3 g |
| Trisodium.nitrilotriacetate, (monohydrate) | 2.5 g |
| Potassium hydroxide | 1.0 g |
| Add water to make | 1 liter |
| Adjust pH to be | pH = 10.0 |
| <Bleach> | |
| Iron ammonium ethylenediamine-tetraacetate | 100.0 g |
| Diammonium ethylenediamine tetraacetate | 10.0 g |
| Ammonium bromide | 150.0 g |
| Glacial acetic acid | 10.0 g |
| Add water to make | 1 liter |
| Adjust pH with aqueous ammonia to be | pH = 6.0 |
| <Fixer> | |
| Ammonium thiosulfate | 175.0 g |
| Sodium sulfite, anhydrous | 8.5 g |
| Sodium metasulfite | 2.3 g |

-continued

| | |
|---|---|
| Add water to make | 1 liter |
| Adjust pH with acetic acid to be | pH = 6.0 |
| <Stabilizer> | |
| Formalin (in an aqueous 37% solution) | 1.5 mili liter |
| Konidux (manufactured by Konica Corp.) | 7.5 mili liter |
| Add water to make | 1 liter |

The above-mentioned sensitivity was a value relative to the reciprocal of the exposure quantity capable of giving a density of Dmin+0.1. Such a relative sensitivity as defined above is expressed by a value relative to the green sensitivity of Sample No. 11 obtained immediately after exposure which is regarded as the value of 100.

RMS graininess is a 1000-magnified value of a density variation produced when scanning a density of Dmin+1.0 through a microdensitometer having an aperture scanning area of 250 $\mu m^2$. Such a graininess as mentioned above is expressed by the RMS value obtained from Sample-11, which is regarded as the value of 100.

Table 14 shows the results for the evaluation of the sensitivity and the RMS graininess of coating samples Nos. 11 through 20 each using Emulsion A, namely Em-1 through Em-10.

-continued

| | |
|---|---|
| (Solution B-3) | |
| 3.5 N silver nitrate aqueous solution | 4650.0 ml |
| (Solution C-3) | |
| Potassium bromide | 2499.0 g |
| Water was added to make 6000 cc in total. | |
| (Solution D-3) | |
| Fine grain emulsion composed of gelatin of 3 weight % and silver iodide grains (an average grain size is 0.05 μm) | 2333.0 g |

The emulsion was prepared in a manner as follows.

Two thousand mililiters of each of an aqueous solution containing 7.06 mols of silver nitrate and an aqueous solution containing 7.06 mols of potassium iodide were added to 5000 ml of a 6.0 wt % gelatin solution containing 0.06 mols of potassium iodide in 10 minutes. The temperature in the course of forming the fine grains was controlled to be 40° C. The finished weight was 12.53 kg.

(Solution E-3)

1.75N potassium bromide aqueous solution

To a react or vessel, Solution A-3 was added. While stirring vigorously, Solutions B-3 through D-3 were added by a double jet method in accordance with combination described in Table 16. Then, seed crystals were grown so that a core/shell type silver halide emulsion was prepared.

The addition rates of (1) solution B-3, solution C-3 and solution D-3 and (2) solution B-3 and solution C-3 were functionally varied over time so as to meet the critical growth rate of the respective silver halide grains wherein the solutions were added at a suitable adding rates so that any small-sized grains other than the growing seed crystals may not be produced and may not be polydispersed by an Ostwald ripening.

The emulsion in the reaction vessel was controlled to be 75° C. and pAg 8.8 in the overall course of the grain growth. Solution E-3 was optionally added to control pAg.

The time the solutions are added and the added silver amount and silver iodide content of silver halide phase formed at the time were shown in Table 5.

After grain growth, the emulsion was subjected to desalting according to a method described in Japanese Patent Application No. 4-59351, mixed with 1.19 liter of an aqueous 20 weight % gelatin solution, dispersed at 50° C. for 30 minutes, adjusted to pH 5.80 and pBr 3.55 at 40° C.

The silver halide grains in the obtained emulsion were monodisperse tabular silver halide grains having an average grain size of 1.65 μm (a diameter converted to a circle of a projected area), an average aspect ratio of 3.5 and a grain size distribution of 16%.

TABLE 15

| Sample No. | Number of Emulsion A | Category | Immediately after exposure: Sensitivity | Immediately after exposure: RMS graininess | Condition A: Sensitivity | Condition A: RMS graininess | Condition B: Sensitivity | Condition B: RMS graininess |
|---|---|---|---|---|---|---|---|---|
| 201 | Em-13 | Comp. | 100 | 100 | 84 | 112 | 79 | 117 |
| 202 | Em-14 | Inv. | 106 | 94 | 103 | 98 | 101 | 98 |
| 203 | Em-15 | Inv. | 110 | 96 | 107 | 98 | 106 | 97 |
| 204 | Em-16 | Inv. | 112 | 94 | 110 | 95 | 111 | 95 |
| 205 | Em-17 | Inv. | 104 | 96 | 102 | 98 | 100 | 98 |
| 206 | Em-18 | Inv. | 109 | 95 | 106 | 96 | 103 | 97 |

As is obvious from the results shown in Table 4, sample-202 through sample-206 of the invention each containing emulsions Em-14 through Em-18 relating to the invention show the same or more excellent photographic performance in terms of sensitivity and RMS graininess compared to comparative emulsions. In addition, when stored under the conditions B, too, the samples each using the silver halide photographic emulsion of the present invention exhibit excellent photographic performance in terms of sensitivity and RMS graininess compared to comparative emulsions.

Example 4

(Preparation of Comparative silver halide emulsion (Em-19))

Hereinafter, a comparative silver halide emulsion (Em-19) was prepared using 5 kinds of solutions.

| | |
|---|---|
| (Solution A-3) | |
| Ossein gelatin | 69.0 g |
| Distilled water | 3321 ml |
| $HO(CH_2CH_2O)_m(CHCH_3CH_2O)_{19.8}(CH_2CH_2O)_nH$ (m + n = 9.77) (10 weight % methanol solution) | 2.50 ml |
| Seed emulsion (T-1) used in Example 1 | 71.8 g |
| Water was added to make 3500 cc in total. | |

TABLE 16

| Added solution | Time in which solutions were added (min.) | Silver weight added (%) | Silver iodide content (mol %) |
|---|---|---|---|
| (1)B-3, C-3, D-3 | 0.00 | 0.0 | 6.0 |
| (1)B-3, C-3, D-3 | 30.43 | 1.0 | 6.0 |
| (1)B-3, C-3, D-3 | 63.65 | 3.0 | 6.0 |
| (1)B-3, C-3, D-3 | 80.79 | 6.0 | 6.0 |
| (1)B-3, C-3, D-3 | 97.72 | 10.0 | 6.0 |
| (1)B-3, C-3, D-3 | 97.72 | 10.0 | 15.0 |
| (1)B-3, C-3, D-3 | 127.35 | 20.0 | 15.0 |
| (1)B-3, C-3, D-3 | 148.53 | 30.0 | 15.0 |
| (1)B-3, C-3, D-3 | 175.94 | 47.0 | 15.0 |
| (1)B-3, C-3, D-3 | 175.94 | 47.0 | 7.0 |
| (1)B-3, C-3, D-3 | 187.87 | 56.0 | 7.0 |
| (1)B-3, C-3, D-3 | 198.41 | 65.0 | 7.0 |
| (2)B-3, C-3 | 198.41 | 65.0 | 0.0 |
| (2)B-3, C-3 | 211.09 | 80.0 | 0.0 |
| (2)B-3, C-3 | 220.45 | 100.0 | 0.0 |

(Preparation of Comparative emulsion (Em-20))

Comparative emulsion (Em-20) was prepared in the same manner as in comparative emulsion (Em-19), except that the emulsion was adjusted to pH 8.0 using an aqueous 10% potassium hydroxide solution 97.72 minutes after addition of solutions B-3 through D-3 had begun. The pH of the emulsion in a reacting vessel was as follows:

| | | | | | |
|---|---|---|---|---|---|
| Time after addition of solutions B-3 through D-3 | 97.72 | 175.94 | 198.41 | 211.09 | 220.45 |
| pH of the emulsion in the vessel | 8.00 | 7.02 | 6.68 | 6.59 | 6.38 |

After the growth of grains, the emulsion was subjected to desalting according to a method described in Japanese Patent Application No. 4-59351, mixed with 1.19 liter of an aqueous 20 weight % gelatin solution, dispersed at 50° C. for 15 minutes, adjusted to pBr 1.5 at 50° C. with a 3.5N potassium bromide solution, and the following solution H-3 was added thereto in 30 seconds under stirring, 10 minutes thereafter the following solution I-3 was added in 30 seconds and 10 minutes thereafter the following solution J-3 was added in 30 seconds, followed by another 20 minutes of stirring. The resulting emulsion was adjusted to pH 5.80 and pBr 3.55 at 40° C.

| | |
|---|---|
| (Solution H-3) | |
| Fine grain emulsion composed of gelatin of 3 wt % and silver bromide grains (an average grain size of 0.04 μm) (The preparation method is shown as follows) | 0.212 mol |
| (Solution I-3) | |
| Fine grain emulsion composed of gelatin of 3 wt % and silver bromide grains (an average grain size of 0.04 μm) (The preparation method is shown as follows) | 0.212 mol |
| (Solution J-3) | |
| Fine grain emulsion composed of gelatin of 3 wt % and silver bromide grains (an average grain size of 0.04 μm) (The preparation method is shown as follows) | 0.212 mol |

Two thousand mililiters of each of an aqueous solution containing 7.06 mols of silver nitrate and an aqueous solution containing 7.06 mols of potassium iodide were added to 5000 ml of a 6.0 wt % gelatin solution containing 0.06 mols of potassium iodide over 10 minutes. The temperature in the course of forming the fine grains was kept at 30° C. During forming fine grains, pH was regulated to 3.0 using nitrate, and then, pH was regulated to 6.0 using an aqueous sodium carbonate solution.

(Preparation of Emulsion (Em-21) of the present invention)

Emulsion (Em-21) of the present invention was prepared in the same manner as in comparative emulsion (Em-19), except that the emulsion was adjusted to pH 6.8 using an aqueous 10% potassium hydroxide solution 97.72 minutes after addition of solutions B-3 through D-3 had begun. The pH of the emulsion in a reacting vessel was as follows:

| | | | | | |
|---|---|---|---|---|---|
| Time after addition of solutions B-3 through D-3 | 97.72 | 175.94 | 198.41 | 211.09 | 220.45 |
| pH of the emulsion in the vessel | 6.80 | 6.52 | 6.42 | 6.35 | 6.19 |

In addition, after the growth of grains, the emulsion was subjected to desalting according to a method described in Japanese Patent Application No. 4-59351, mixed with 1.19 liter of an aqueous 20 weight % gelatin solution, dispersed at 50° C. for 15 minutes, adjusted to pBr 1.5 at 50° C. with a 3.5N potassium bromide solution, and the following solution H-I was added thereto in 30 seconds while stirring, followed by another 20 minutes of stirring. The resulting emulsion was adjusted to pH 5.80 and pBr 3.55 at 40° C.

| | |
|---|---|
| (Solution H-4) | |
| Fine grain emulsion composed of gelatin of 3 wt % and silver bromide grains (an average grain size of 0.04 μm) (The preparation method is shown as follows) | 0.212 mol |
| (Solution I-4) | |
| Fine grain emulsion composed of gelatin of 3 wt % and silver bromide grains (an average grain size of 0.04 μm) (The preparation method is shown as follows) | 0.212 mol |
| (Solution J-4) | |
| Fine grain emulsion composed of gelatin of 3 wt % and silver bromide grains (an average grain size of 0.04 μm) (The preparation method is shown as follows) | 0.212 mol |

The thousand mililiters of each of an aqueous solution containing 7.06 mols of silver nitrate and an aqueous solution containing 7.06 mols of potassium iodide were added to 5000 ml of a 6.0 wt % gelatin solution containing 0.06 mols of potassium iodide over 10 minutes.

The temperature in the course of forming the fine grains was kept at 30° C. During forming fine grains, pH was regulated to 3.0 using nitrate, and then, pH was regulated to 6.0 using an aqueous sodium carbonate solution.

Table 17 shows the characteristics of emulsions (Em-19) through (Em-21).

TABLE 17

| Emulsion Nos. | Category | Average grain size | Average grain aspect ratio | Average grain size distribution (%) | Average silver iodide content of the surface of grains $I_1$: (mol %) | Average silver iodide content of grains $I_2$: (mol %) | Average silver iodide content of high iodide content of the inner portions of grains (mol %) | Reduction sensitization method | Portions reduction sensitized | Shapes of grains | Ammonium compound | The ratio of a projected area occupied by tabular grains to that of the total grains |
|---|---|---|---|---|---|---|---|---|---|---|---|---|
| Em-19 | Comp. | 1.65 | 3.5 | 16 | 7.8 | 7.5 | 15 | — | — | Tabular | None | 91 |
| Em-20 | Inv. | 1.68 | 3.7 | 16 | 4.0 | 7.4 | 15 | pH 8.0 | Core-shell | Tabular | None | 90 |
| Em-21 | Inv. | 1.66 | 3.5 | 16 | 3.9 | 7.4 | 15 | pH 6.8 | Core-shell | Tabular | None | 92 |

Emulsions (Em-19) through (Em-21) were respectively subjected to the most suitable chemical sensitization. These emulsions were respectively used in the following formulation for samples under the name of (Emulsion A) in Exmple 3 so that multilayered color photographic light-sensitive material samples Nos. 207 through 209 were prepared.

Multilayered color photographic light-sensitive material samples Nos. 207 through 209 thus prepared were evaluated in the same manner as in Example 3.

Table 18 shows the results thereof.

TABLE 18

| Sample No. | Number of Emulsion A | Category | Immediately after exposure | | Condition A | | Condition B | |
|---|---|---|---|---|---|---|---|---|
| | | | Sensitivity | RMS graininess | Sensitivity | RMS graininess | Sensitivity | RMS graininess |
| 207 | Em-19 | Comp. | 100 | 100 | 87 | 114 | 85 | 112 |
| 208 | Em-20 | Inv. | 115 | 98 | 112 | 102 | 113 | 101 |
| 209 | Em-21 | Inv. | 105 | 101 | 103 | 104 | 101 | 105 |

As is obvious from the results shown in Table 18, sample-208 and sample-209 of the invention each containing emulsions Em-20 and Em-21 relating to the invention shows the same or more excellent photographic performance in terms of sensitivity and RMS graininess compared to comparative emulsions when they were stored under the conditions of A. In addition, when stored under the conditions B which were severer conditions, too, the samples each using the silver halide photographic emulsion of the present invention exhibit excellent photographic performance in terms of sensitivity and RMS graininess compared to comparative emulsions.

What is claimed is:

1. A silver halide photographic emulsion containing silver halide grains having an average iodide content of not less than 4 mol %, said grains comprising an internal silver halide phase having an average iodide content of from 8 mol % to a solid solution limit, and a surface silver halide phase having a thickness of 50 Å from the grain surface and an average iodide content of 1.5 to 4.5 mol %.

2. The silver halide emulsion of claim 1, wherein said surface phase comprises an outermost silver halide phase having a thickness of three lattice planes from the surface and an average iodide content of 1.5 to 4.5 mol %.

3. The silver halide emulsion of claim 1, wherein said silver halide grains are internally reduction-sensitized.

4. The silver halide emulsion of claim 1, wherein 60 % or more of the projected area of total grains are tabular grains having an average aspect ratio of diameter to thickness of not less than 1.3 and less than 5.0.

5. The silver halide emulsion of claim 1 wherein said internal silver halide phase has an average iodide content of from 10 mol % to a solid solution limit.

6. A method for preparing a silver halide emulsion wherein said silver halide emulsion contains silver halide grains having an average iodide content of not less than 4 mol %, and comprising an internal silver halide phase having an average iodide content of from 8 mol % to a solid solution limit, and a surface phase having a thickness of 50 Å from the grain surface, and an average iodide content of 1.5 to 4.5 mol %; said method comprising the steps of:

(i) forming a silver halide grain emulsion by mixing a water-soluble silver salt and a water-soluble halide to form an emulsion, (ii) subjecting said emulsion to washing to remove soluble salt, and (iii) subjecting said emulsion to chemical sensitization, wherein, after washing and before chemical sensitization, silver halide fine grains are added to the emulsion to form at least a part of said surface phase of said grains.

7. The method of claim 6, wherein said silver halide fine grains have an average iodide content of not more than 4.5 mol %.

8. The method of claim 7, wherein said silver halide fine grains have an average grain size of not more than 0.1 μm.

9. The method of claim 6, wherein, in step (i), the emulsion is subjected to reduction sensitization by adding a reductant thereto, or by making a change of pAg of the emulsion to not more than 7.0 or pH of the emulsion to not less than 7.0 at a time before completing mixing of the silver and halide salts.

10. The method of claim 6 wherein said internal silver halide phase has an average iodide content of from 10 mol % to a solid solution limit.

* * * * *